US006607332B2

(12) United States Patent
Kang

(10) Patent No.: US 6,607,332 B2
(45) Date of Patent: Aug. 19, 2003

(54) METHOD OF REINFORCING SLOPE REVERSE ANALYSIS TECHNIQUE

(76) Inventor: Soo-Yong Kang, New Town Apt. 13-1201, Bisan-3dong 341, Dongan-ku, Anyang-si, Kyunggi-do 431-819 (KR)

( * ) Notice: Subject to any disclaimer, the term of this patent is extended or adjusted under 35 U.S.C. 154(b) by 0 days.

(21) Appl. No.: 09/943,204

(22) Filed: Aug. 30, 2001

(65) Prior Publication Data

US 2003/0082014 A1 May 1, 2003

(51) Int. Cl.[7] ..... E02D 3/00; C09K 17/00

(52) U.S. Cl. ..... 405/287.1; 405/19; 405/258.1; 405/262; 405/302.4

(58) Field of Search ..... 405/15–17, 19, 405/287.1, 258.1, 262, 302.4, 302.6, 303, 387

(56) References Cited

U.S. PATENT DOCUMENTS

| | | | | | |
|---|---|---|---|---|---|
| 360,225 | A | * | 3/1887 | Kanters | 405/19 |
| 3,802,204 | A | * | 4/1974 | Mason | 405/262 |
| 4,610,568 | A | * | 9/1986 | Koerner | 405/258.1 X |
| 4,714,376 | A | * | 12/1987 | Jenab | 405/258.1 X |
| 6,158,284 | A | * | 12/2000 | Miller | 73/597 |

FOREIGN PATENT DOCUMENTS

| | | | | |
|---|---|---|---|---|
| FR | 2680381 | * | 2/1993 | |
| JP | 59015127 | * | 1/1984 | 405/272 |
| JP | 61028624 | * | 2/1986 | 405/262 |
| JP | 61134439 | * | 6/1986 | 405/15 |
| JP | 01226913 | * | 9/1989 | |
| JP | 02147723 | * | 6/1990 | 405/262 |
| JP | 0874260 | * | 3/1996 | |
| JP | 08209704 | * | 8/1996 | |
| JP | 10140551 | * | 5/1998 | |
| JP | 11021907 | * | 1/1999 | |
| JP | 2000160572 | * | 6/2000 | |
| JP | 200031988 | * | 11/2000 | |

OTHER PUBLICATIONS

R.N. Chowdhury,"Slope Analysis", Developments in Geotechnical Engineering vol. 22, Elsevier Scientific Publishing Company 1978.*

* cited by examiner

*Primary Examiner*—Jong-Suk (James) Lee
(74) *Attorney, Agent, or Firm*—Abelman, Frayne & Schwab

(57) ABSTRACT

A method for reinforcing a slope in which field ground deformation characteristics of an unstable slope can be rapidly and reliably judged and the unstable slope recovered and restored to its own natural state by introduction and application of an earth reinforcement theory, where apparent cohesion is increased by reinforcement members. This slope reinforcing method includes the steps of: determining application conditions in connection with an applicable limit based on soil parameters using the reverse analysis technique of the Janbu method; analyzing the stability of the slope using the Janbu soil parameters to obtain an estimated slip failure force and a resistance force of the slope; defining a construction section of a reinforcement zone in order to increase the resistance force of the slope; disposing horizonal slope drain holes based on underground water level conditions to study an external stability; checking an internal stability within the reinforcement zone against a critical failure section in consideration of a pull-out force and shear capacity of the reinforcement member; preparing design drawings; carrying out the reinforcement construction work; and treating surfaces with greening soil.

7 Claims, 19 Drawing Sheets

$$\sigma'_1 = \frac{\sigma_{1p} + \sigma_{1r}}{2}$$

$$\sigma'_2 = \frac{\sigma_{2p} + \sigma_{2r}}{2}$$

$$\sigma'_3 = \frac{\sigma_{3p} + \sigma_{3r}}{2}$$

METHOD OF REINFORCING SLOPE REVERSE ANALYSIS TECHNIQUE

BACKGROUND OF THE INVENTION

1. Field of the Invention

The present invention relates to a method for reinforcing a slope, and more particularly to such a method, which is capable of recovering and restoring the slope as the status quo so as to maintain its stability without additional reduction of its gradient using a reverse analysis technique.

2. Description of the Prior Art

In the case of artificially constructing a slope by excavating or cutting a natural sloping land, the slope gradually loses its stability as time goes by and is finally degraded or deformed to do damage to a person's life or property. Additional cutting or reinforcement, thus, is needed when there is a problem in the stability of the excavated or cut slope, but it is impossible in some cases to additionally cut the slope in view of its topographical features. The present invention provides a method for reinforcing the already-constructed slope so as to make it possible to stabilize it and restore it to its own natural state by means of an environmentally favorable method of construction.

A reinforcing method by a soil nailing method has been conventionally used as the method of reinforcing the slope. The conventional slope reinforcing method by the soil nailing method is based on a limit equilibrium analysis in which a static limit equilibrium theory is introduced to examine an overall failure surface over the entire soil. Such a soil nailing method includes Davis method proposed by Shen et al. in 1981, a method proposed by Gassier and Gudenhus and considering only tensile capacity of a reinforcement member (soil nail), and a French method, proposed in 1983, considering an effect of shear capacity on the overall stability and bending stiffness in accordance with the tensile capacity of the reinforcement member, the last one having been practically used up to the present. The soil nailing method is a method in which soil parameters of the ground are determined in advance on the basis of results from a laboratory test and a field test in situ, an internal stability condition is studied to be adapted to characteristics of the reinforcement member, and then an external stability condition is studied. Herein, the internal stability condition is a stability condition for the reinforcement member capable of resisting a slope failure force under a condition for limit equilibrium state, and the external stability condition is a stability condition for such a case that a slope failure line is located at an outer periphery of the reinforcement member. In the soil nailing method, the surface of the slope is subjected to a surface treatment by a stiff structure using concrete or shotcrete. At present, this structure constructed by the soil nailing method is practically used as a vertical excavation-type bracing structure.

FIG. 1 is a schematic diagram showing the slope reinforcing method in accordance with the soil nailing method. The soil nailing method comprises the steps of studying a underground water level and special conditions in connection with an applicable limit; determining soil parameters by a field in situ test, a borehole pressure meter test, a laboratory soil test, etc.; calculating a skin friction resistance by a pull-out test to determine an adhesion force of a nail; determining construction spacing, drilling angles and lengths of the nails on the basis of the determined soil parameters and adhesion force to study an internal stability condition; calculating a post-reinforcement stability by iterative calculations on assumed slope failure line of the ground; planning design of a construction section in accordance with the determined results and constructing the nails; and treating the constructed surface with a stiff structure of concrete or shotcrete.

The slope reinforcing method by the soil, nailing method, however, has no backup measures to counter a case that the values of the soil parameters (a cohesion (C), an internal friction angle ($\phi$), a construction density ($\gamma$), an elastic modulus ($E_s$), a limiting pressure ($p_1$) or the like) applied to the design do not correspond with field deformation behavior, and thus cannot overcome problems arising due to deciding the soil parameters determined by the field test in situ, the laboratory test and so forth as representative values. Also, the method cannot predict maximum tensile and shear forces formed within the given reinforcement member in a certain position, but provides only an overall factor of safety. That is, the following expression is established:

$$V_t = \frac{R_c}{\left[1 + 4\tan^2\left(\frac{\pi}{2} - \alpha\right)\right]^{\frac{1}{2}}} \cong T_t = 4V_t\tan\left(\frac{\pi}{2} - \alpha\right) \qquad \text{[Exp. 1]}$$

wherein $V_t$ is a shear force, $T_t$ is a tensile force, $R_c$ is a shear strength, and $\alpha$ is an angle of a potential failure plane. As seen from Expression 1, only the tensile force acts if $\alpha=0$ and only the shear force is effective if $$\alpha = \frac{\pi}{2}$$

because there is a relationship of $$R_c = \frac{R_n}{2}.$$

The Davis method and French method are typically cited as basic analysis techniques of slope reinforcement by the soil nailing method. The Davis method considers only a tensile resistance and the French method considers a tensile resistance together with the shear resistance (cf. Technical Teaching report 78, Earth Reinforcement, 1989. 12, The Korean Highway Corporation).

According to the analysis by the French method, the tensile force within the upper reinforcement member must be 0 when an estimated potential failure line actually has a longitudinal extension direction $$\left(\alpha = \frac{\pi}{2}\right)$$

in an upper portion of the slope, but the tensile force is practically strengthened in the reinforcement member, thereby causing a problem in analysis.

As stated above, the conventional reinforcing method by the soil nailing method is a method in which an overall surface treatment of a nail head with concrete or shotcrete is performed as the final process after the soil nail reinforcement, thus having many problems, for example, spoilage of a fine view, difficulty in maintenance, lack of environmental intimacy due to spoiling of a natural scene and the like. Besides, since the analytic technique is one in which a field investigation, sampling, a laboratory test, a field location test (PMT), etc. are performed in advance to analyze ground strength characteristics and then the analyses of the slope stability and the reinforcing method are conducted on the basis of results of the ground strength characteristics, it not only requires a heavy cost and a long time, but often causes a problem in that the theoretical strength characteristics do not correspond with the actual field conditions. That is, there is a problem in that a failure model about a theoretical analysis does not correspond with a field failure model.

SUMMARY OF THE INVENTION

A countermeasure to reinforce a slope requires a rapid, accurate and safe reinforcing method capable of minimizing damage to a person's life and property.

The present invention relates to such a method, in which a slope stability analysis is performed while ground strength characteristics suitable to a field failure model are most rapidly and easily analyzed by applying a reverse analysis technique based on field ground deformation characteristics so as to be make it possible to rapidly judge the-above mentioned problems at a low cost, and then a reinforcement construction is rapidly and safely carried out.

For the purpose of this, the present invention provides an environmentally favorable method of slope earth reinforcement without spoilage of a natural environment, which comprises a process of reversely analyzing the field ground deformation characteristics of the unstable slope to make it possible to judge the ground strength characteristics and a process of recovering and restoring the unstable slope by introducing and applying an earth reinforcement theory, i.e., a theory that an apparent cohesion is increased by reinforcement members so as to make it possible to secure stability.

That is, the present invention has been made to solve the above-mentioned problems and to prevent a slope from gradually losing its stability as time goes by and being finally degraded or deformed to do damage to a person's life or property, it is an object of the present invention to provide a reinforcing method for environmentally favorably, economically and rapidly reinforcing such an unstable slope without removal thereof, which comprises a process of accurately and rapidly determining ground strength characteristics of the deformed slope by applying a reverse analysis technique so as to make it possible to most economically and rapidly reinforce the unstable slope, a process of providing slope drain holes (subterranean horizontal drain holes) in the slope in order to suppress action of pore water pressure, using a reinforcing steel bar as a reinforcement member, filling grout composed of cement, water and high fluidizing agent around the reinforcing steel bars to integrate the reinforcement members with ambient earth and rock and so to form reinforced earth with permeation and cementation of the grout in micro-cracks existing within the unstable slope, thereby making it possible to most rapidly and safely reinforce the slope applying an earth reinforcement theory, i.e., a theory that an apparent cohesion is increased by the reinforcement members, and a process of treating a surface portion of the slope by covering artificial greening soil covering containing natural monofilaments so as to make vegetation growth on the slope possible, thereby environmentally favorably reinforcing the slope without spoilage of natural environment.

To accomplish this object, there is provided a method for reinforcing a slope in accordance with the present invention, the method comprising the steps:

- studying a underground water level, slope configuration, a soil condition status and rock joint orientation in connection with an applicable limit of the slope, on the basis of which soil parameters, including a cohesion and an internal friction angle, are determined using the Janbu method so as to be adapted to characteristics of the deformed ground;
- analyzing stability of the slope using the soil parameters determined by the Janbu method to estimate a driving force and a resistance force of the slope;
- planning a construction section of a reinforcement zone to be constructed with reinforcement members in order to increase the resistance force of the slope;
- determining a position and a quantity of subterranean horizontal drain holes in consideration of the underground water level condition to study an external stability;
- checking an internal stability within the reinforcement zone against a critical failure section in consideration of a pull-out force and a shear capacity of the reinforcement member; and
- preparing design drawings so as to satisfy the external and internal stabilities and carrying out a reinforcement construction work.

An apparent cohesion increasing with construction spacing between the reinforcement members is preferably $$C' = \frac{3.6}{\bar{\gamma}} \sim \frac{4.2}{\bar{\gamma}}$$

when a SD40:ϕ25M/M reinforcing steel bar is used, $$C' = \frac{4.9}{\bar{\gamma}} \sim \frac{5.6}{\bar{\gamma}}$$

when a SD40:ϕ29M/M reinforcing steel bar is used, $$C' = \frac{5.9}{\bar{\gamma}} \sim \frac{7.0}{\bar{\gamma}}$$

($t/m^2$) when a SD40:ϕ32M/M reinforcing steel bar is used as a nail bar.

Preferably, the step of carrying out the reinforcement construction work comprises the steps of: insert-laying the reinforcement members in the slope in accordance with the design drawings; mixing cement, water and high fluidizing agent with each other to produce grout and gravitationally injecting the grout around the reinforcement members; laying slope drain holes in the slope in such a manner that they extend beyond the reinforcement zone in accordance with the design drawings; installing main earth-pressing steel plates, PVC-coated wire mesh and sub earth-pressing steel plates to fix the reinforcement members; and treating surfaces of the slope with general artificial greening soil covering or artificial greening soil covering mixed with natural monofilaments by a spray attaching vegetation method.

It is preferred that a safety factor of the slope is 1.4 or more in the construction section of the reinforcement zone.

As for a weathered residual soil layer slope or a rock mass slope having remarkable joint orientation, the step of an determining the soil parameters may be performed by determining a dip angle (a bedding plane angle or a plunge angle) (θ) of the slope joint as the internal friction angle (ϕ) and inversely calculating a cohesion (C) at the determined internal friction angle under a condition for limit equilibrium state $F_s \leqq 1.0$.

As for an unsaturated earth cut slope ground, the step of determining the soil parameters may be performed by determining the internal friction angle (ϕ) through a direct shear test and inversely calculating the cohesion (C) at the constant internal friction angle (ϕ=const.) under a condition for limit equilibrium state $F_s=1.0$.

In the case of degradation or deformation of the slope, the step of determining the soil parameters may be performed by determining the internal friction angle (ϕ) through the direct shear test and inversely calculating the cohesion (C), considering an estimated failure line under a condition for limit equilibrium state of $0.85 \leqq F_s \leqq 1.03$.

In the case that the slope is unstable and forms an irregular stratified profile corresponding to a limit equilibrium state, the step of determining the soil parameters may be performed preliminarily by assuming that a critical failure line passes through the lowest portion of an upper stratum of the slope, determining the internal friction angle ($\phi_r$) through the direct shear test for a specimen of the upper stratum of the slope and inversely calculating the cohesion (C) under a condition for limit equilibrium state $0.9 \leqq F_s \leqq 1.05$, and secondarily by assuming that the critical failure line passes through the lowest portion of a lower stratum of the slope, determining the internal friction angle ($\phi_r'$) through the direct shear test for a specimen of the lower stratum of the slope and inversely calculating the cohesion (C') under a condition for limit equilibrium state $0.9 \leqq F_s \leqq 1.05$.

BRIEF DESCRIPTION OF THE DRAWINGS

The above and other objects, features and other advantages of the present invention will be more apparent from the following detailed description taken in conjunction with the accompanying drawings, in which.

DETAILED DESCRIPTION OF THE PREFERRED EMBODIMENTS

Figure 1:
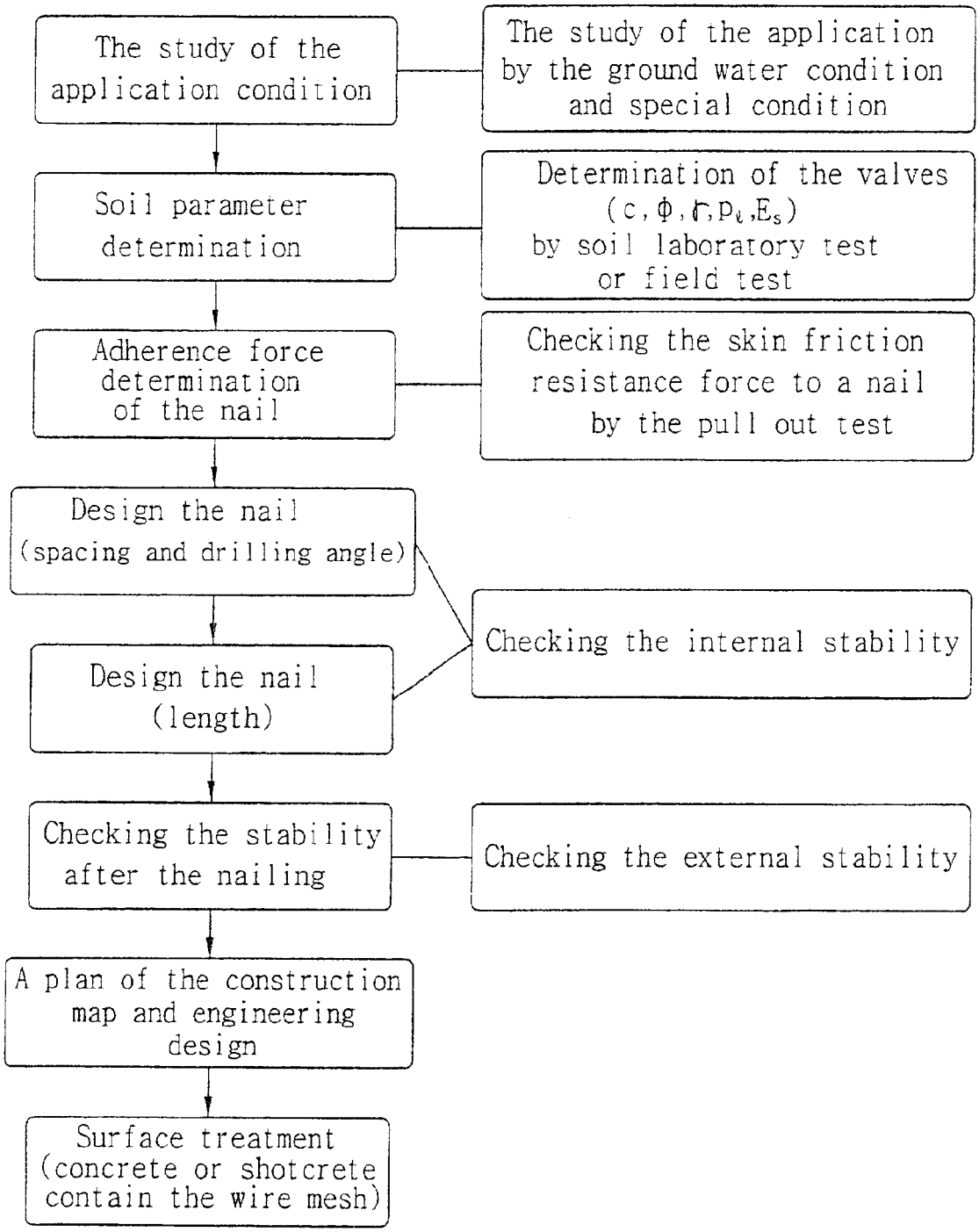
Fig. 1 PRIOR ART
FIG. 1 is a schematic diagram showing a conventional slope reinforcing method in accordance with a soil nailing method.

Hereinafter, a preferred embodiment of the present invention will be described with reference to the accompanying drawings. In the following description and all drawings, the same reference numerals are used to designate the same or similar components, and so repetition of the description of the same or similar components will be omitted.

Figure 2:
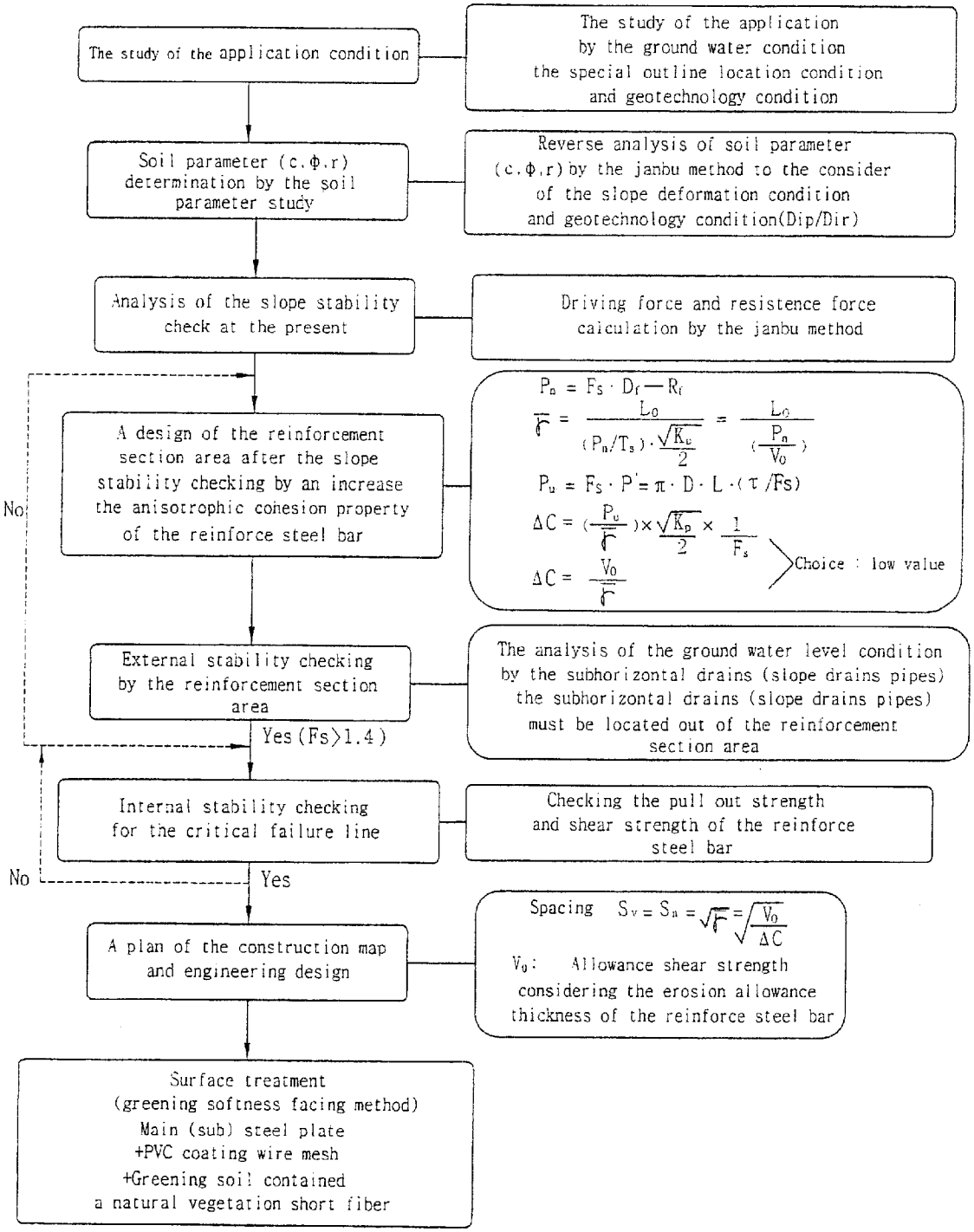
FIG. 2 is a schematic diagram showing a slope reinforcing method in accordance with the present invention.

FIG. 2 is a schematic diagram view showing a method for reinforcing a slope using a reverse analysis technique in accordance with the present invention.

A basic principle of the slope reinforcing method using the reverse analysis in accordance with the present invention is as follows:

Henry Vidal, a Frenchman, discovered that seashore sand can be heaped up higher and endure a greater external force when pine needles are put into the sand than when only the sand is heaped up. This is due to a principle that the sand in contact with reinforcement members is linked with the reinforcement members by fiction forces therebetween, and the sand out of contact with the reinforcement members is linked with the reinforcement members owing to a property of stress transition to the reinforcement members according to a phenomenon of an internal stress transmission by friction between sand particles, that is, an arching phenomenon when the reinforcement members are disposed at a constant spacing within the sand, which results in forming a lump structural body in which the whole sand is contacted or linked with the reinforcement members, i.e., a reinforced earth having a far greater strength than the pure sand.

The increase in strength of the sand by the reinforcement members is achieved in such a manner described below.

Figure 3:
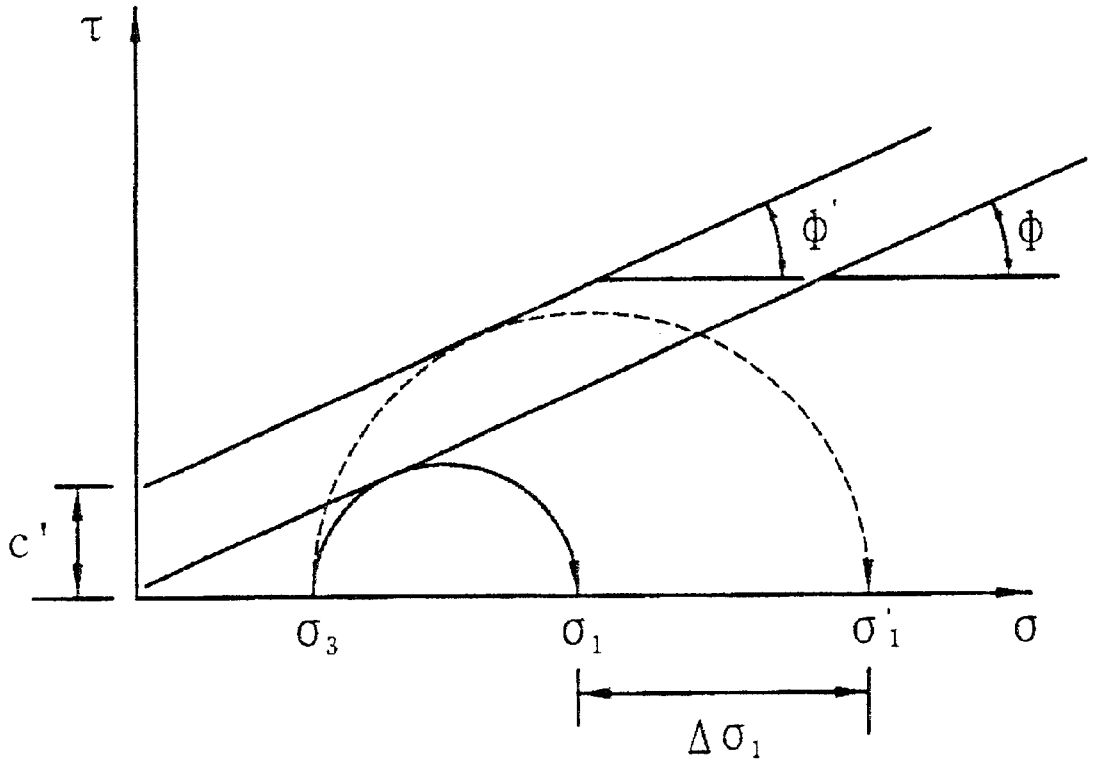
FIG. 3 is a graph showing an apparent cohesion increased by reinforcement members.

FIG. 3 is a graph showing an apparent cohesion increased by the reinforcement members, in which the apparent cohesion (anisotropic cohesico,) is increased due to increase of a vertical stress caused by the reinforcement members.

$\Delta\sigma_1$ is an incremental value of the vertical stress caused by the reinforcement members, which leads to an increase of compressive strength of the reinforced sand with the result that the apparent cohesion is increased by the reinforcement members horizontally reinforcing the sand.

Figure 4:
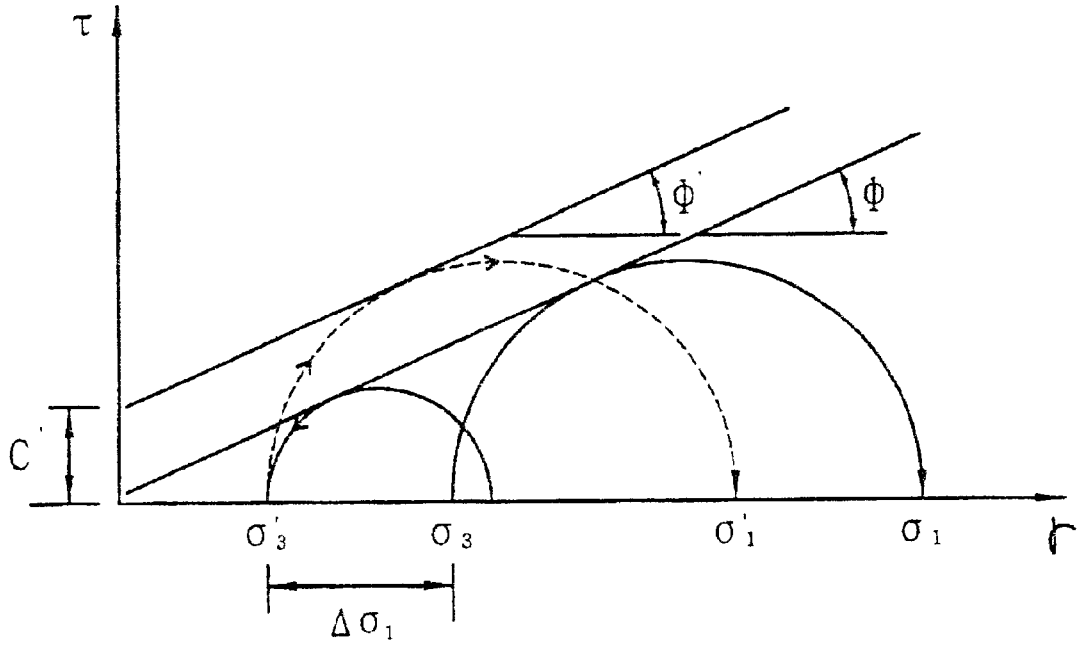
FIG. 4 is a graph showing the apparent cohesion whose restraint stress is increased by the reinforcement members.

FIG. 4 shows that a restraint stress is increased by the reinforcement members. With respect to the restraint stress increased by the reinforcement members, whereas the pure sand horizontally expands when the vertical stress ($\sigma_v$) is increased, the reinforced sand suppresses a horizontal displacement by friction forces between the sand and the reinforcement members when the vertical stress ($\sigma_v$) is increased. That is, as shown in FIG. 4, the restraint stress ($\Delta\sigma_3$) in addition to a lateral pressure ($\sigma_3$) is applied to the reinforced sand by the friction forces generated between the sand and the reinforcement members to increase the compressive strength of the reinforced sand.

Figure 5A:
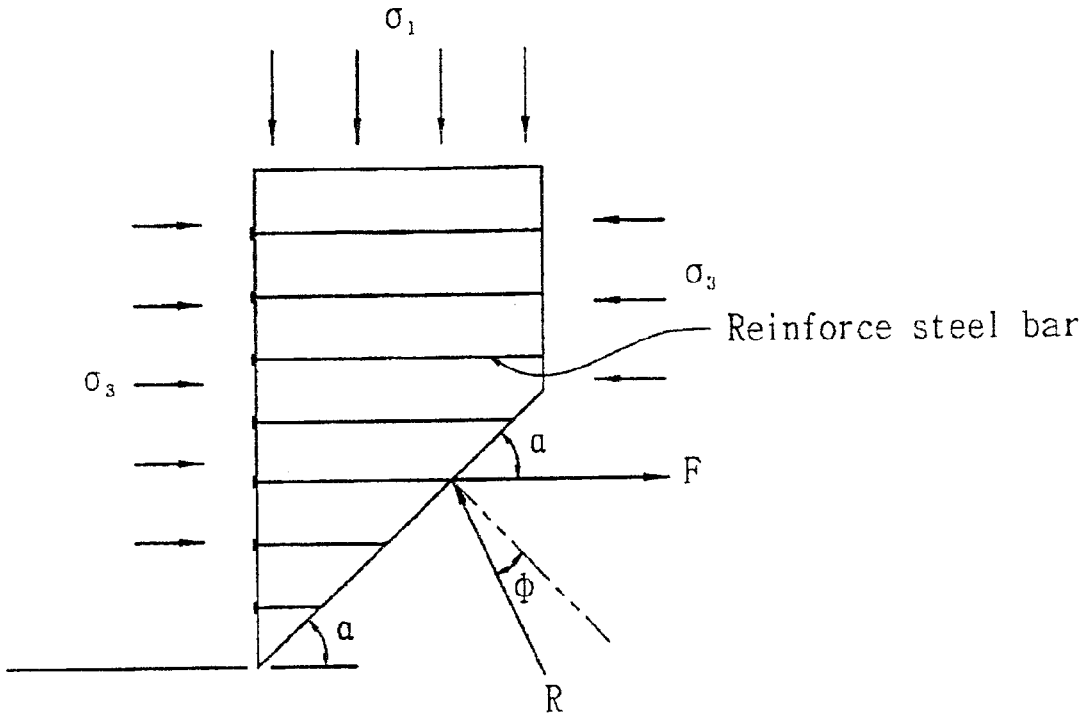
FIGS. 5*a* and 5*b* are views showing forces acting on a failure plane by the reinforcement member and a triangle of force for those forces, respectively.
Figure 5B:
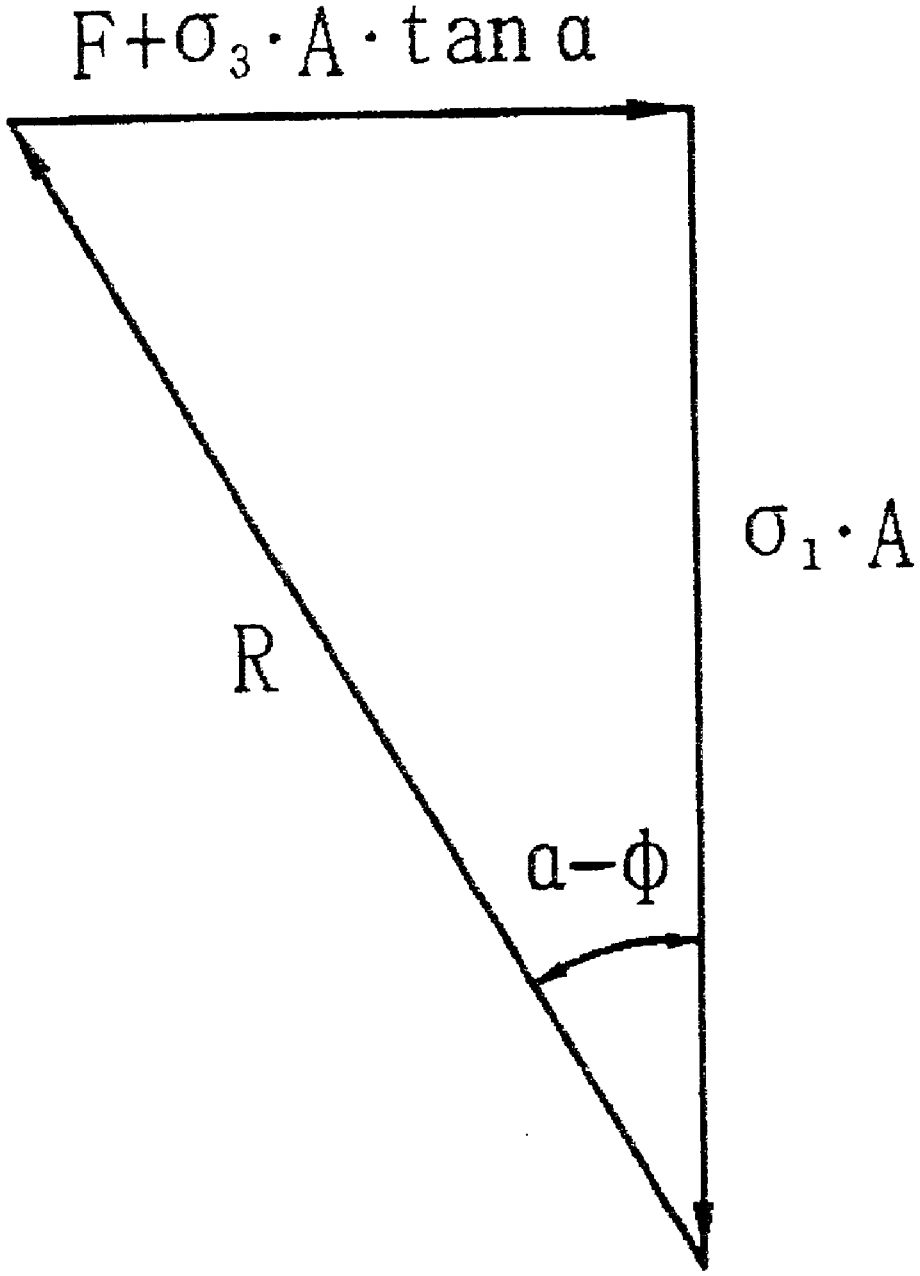

In the reinforced sand whose apparent cohesion is increased by the reinforcement members, the apparent cohesion to which Coulomb's theory is applied is as follows:

FIGS. 5*a* and 5*b* show forces acting on a failure plane by the reinforcement members and a triangle of force for those forces, respectively, with reference to which the following expression is established:

$$\tan(\alpha-\phi)=\frac{F+\sigma_3\cdot A\cdot\tan\alpha}{\sigma_1\cdot A} \quad \text{[Exp. 2]}$$

wherein A is a cross sectional area of the reinforced sand, $\alpha$ is a horizontal angle of a failure plane, F is a sum of tensile forces of the respective reinforcement members cut by the failure plane, and $\phi$ is an internal friction angle of the sand.

On the other hand, the sum of tensile forces acted by the respective reinforcement members is given by the following expression:

$$F=\frac{A\cdot\tan\alpha}{\Delta H}\cdot T, \quad \text{[Exp. 3]}$$

wherein $\Delta H$ is vertical spacing between the reinforcement members per unit width and $T_s$ is a tensile force of the respective reinforcement members per unit width.

The following relational expressions can be derived from Exps. 2 and 3:

$$\frac{A\cdot\tan\theta}{\Delta H}\cdot T_s+\sigma_3\cdot A\cdot\tan\alpha=\sigma_1\cdot A\cdot\tan(\alpha-\phi) \quad \text{[Exp. 4]}$$

$$\sigma_1=\tan\alpha\left(\frac{T_s}{\Delta H}+\sigma_3\right)\cot(\alpha-\phi) \quad \text{[Exp. 5]}$$

wherein $\sigma_1$ is a vertical stress, $\alpha$ is a failure angle, $K_p$ is a passive earth pressure factor, and $\phi$ is an internal friction angle of earth. In Exp. 1, $$\alpha=45^\circ+\frac{\phi}{2} \text{ and } K_p=\tan^2\left(45^\circ+\frac{\phi}{2}\right)$$

if $\sigma_1$ is maximal, and thus the vertical stress is given by the following expression:

$$\sigma_1=K_p\cdot\sigma_3+K_p\cdot\frac{T_s}{\Delta H} \quad \text{[Exp. 6]}$$

Since the vertical stress is $\sigma_1=K_p\cdot\sigma_3+\Delta\sigma_1$ when the reinforced sand experiences failure, the following expression is established:

$$K_p\sigma_3+\sigma_1=K_p\cdot\sigma_3+K_p\cdot\frac{T_s}{\Delta H} \quad \text{[Exp. 7]}$$

wherein $\sigma_3$ is a horizontal stress and $\Delta\sigma_1$ is an increment of the vertical stress.

Consequently, the following expression can be derived from Exps. 6 and 7:

$$\Delta\sigma_3=K_p\cdot\frac{T_s}{\Delta H} \quad \text{[Exp. 8]}$$

$\Delta\sigma_1$ is the increment of the vertical stress caused by the reinforcement members, which is expressed using the apparent cohesion (C') as follows:

$$\sigma_1=K_p\cdot\sigma_3+2\sqrt{K_p}\cdot C' \quad \text{[Exp. 9]}$$

From Exps. 6 and 9, the apparent cohesion (C') can be expressed by the following expression (Gunkiyeon 84-W-1 Research Report, "The Study of Geo-textile and Earth Reirinforcement", March 1985, Korea Institute of Construction Technology):

$$C'=\frac{K_p\cdot\frac{T_s}{\Delta H}}{2\sqrt{K_p}}=\frac{T_s}{\Delta H}\cdot\frac{\sqrt{K_p}}{2} \quad \text{[Exp. 10]}$$

According to the result from Juran's model test in 981, the apparent cohesion of Exp. 10 can be converted to the following expression:

$$C_o=\frac{\Sigma V_o}{A} \quad \text{[Exp. 11]}$$

wherein $V_o$ is a shear force of the reinforcement members and A is a reinforcement cross sectional area.

When the tensile force, that is, a skin friction resistance force around the reinforcement members acts to the same or greater extent than the shear force of the reinforcement members, the following relationship is obtained from Exps. 10 and 11:

$$\frac{\Sigma V_o}{A}=\frac{T_s}{\Delta H}\cdot\frac{\sqrt{K_p}}{2} \quad \text{[Exp. 12]}$$

$$\Sigma V_o=\frac{T_s}{\Delta H}\cdot\frac{\sqrt{K_p}}{2}\cdot A \quad \text{[Exp. 13]}$$

Figure 6:
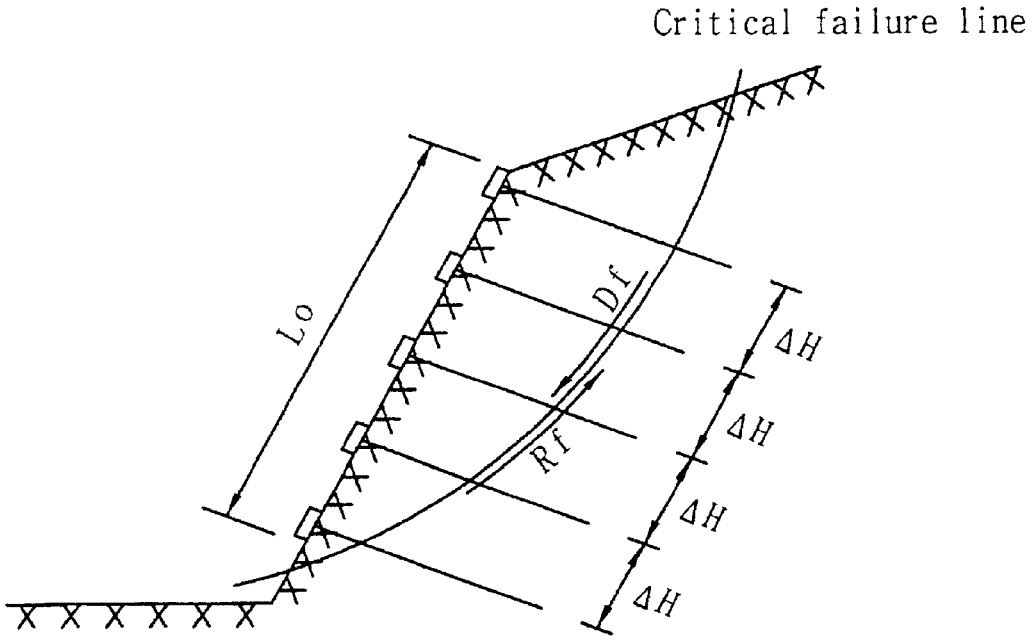
FIG. 6 is a sectional layout view of the reinforcement members to be grouted in the unstable slope.

Herein, the reinforcement members are grouted in the unstable slope as planned in FIG. 6.

In FIG. 6, $L_o$ is length of the reinforced slope per unit linear meter, $\Delta H$ is construction spacing between the reinforcement members per unit linear meter, $D_t$ is a driving force of slope failure per unit linear meter, and $R_t$ is a resistance force against a slip failure plane per unit linear meter.

Since $$\Delta H=\frac{L_o}{n}=\bar{\gamma}$$

($\bar{\gamma}$ is a construction density of the reinforcement members, i.e., the number of the reinforcement members per unit area) if $A=L_o$, $V_o$ of Exp. 13 is as follows:

$$\Sigma V_o=\frac{T_s}{\frac{L_o}{n}}\cdot\frac{\sqrt{K_p}}{2}\cdot L_o=T_s\cdot\frac{\sqrt{K_p}}{2}\cdot n \quad \text{[Exp. 14]}$$

Because of $\Sigma V_o=nV_o$ (n is the number of the reinforcement members), the following expression is established:

$$V_o\approx T_s\cdot\frac{\sqrt{K_p}}{2} \quad \text{[Exp. 15]}$$

A stability study based on the friction resistance (tensile force) of the grout around the reinforcement members is required in the case of earth, and a stability study based on the shear force or the friction force of the reinforcement members is required in the case of a rock mass.

With regard to a stability condition of the slope, a suppression force required for reinforcement is necessary in order to secure a sufficient stability condition against the slip failure driving force in the following case:

$$F_s = \frac{R_f}{D_f} = \frac{ResistanceForce}{DrivingForce} \leq 1.0 \quad \text{[Exp. 16]}$$

That is, under the following condition, $$F_s = \frac{R_t + P_n}{D_f} \quad \text{[Exp. 17]}$$

$$P_n = F_s \cdot D_f - R_t \quad \text{[Exp. 18]}$$

the suppression force required for reinforcement ($P_n$) is expressed as $P_n = \Sigma V_o \approx nV_o$ when the stability condition is planned by means of the shear force of the reinforcement members.

Thus, the construction density of the reinforcement members ($\bar{\gamma}$) is as follows:

$$\bar{\gamma} = \frac{L_o}{n} = \frac{L_o}{\dfrac{P_n}{T_s \cdot \dfrac{\sqrt{K_p}}{2}}} \quad \text{[Exp. 19]}$$

Since the stability condition for the pull-out resistance is given as below, $$P_u = F_s \cdot P' = \pi DL \cdot \frac{\tau}{(F_s)'} \quad \text{[Exp. 20]}$$

the designed tensile force ($V_o$) s as follows:

$$P' = \frac{P_u}{F_s} \approx T_s \quad \text{[Exp. 21]}$$

wherein $P_u$ is an ultimate pull-out resistance force, $\tau$ is a friction resistance force of the grout and the ambient ground, D is a borehole drilling diameter, and L is a length of the reinforcement members.

A stress limiting condition for the reinforcement members is as follows:

A deformed bar (SD35 or SD40) is used as the reinforcement member. A long-term allowable stress of the deformed bar is 2000 kg/cm$^2$ for shear reinforcement and is 2200 kg/cm$^2$ (or 2000 kg/cm$^2$) for tensile reinforcements. An allowable tensile stress ($T_s$) of the reinforcement members is substantially equal to the pull-out resistance force ($P_u$), an allowable shear stress ($V_o$) of the reinforcement members is also substantially equal to the pull-out resistance force ($P_u$), and the resistance force ($P_n$) required for suppressing the slope failure driving force is smaller than an allowable shear reinforcement stress ($\Sigma V_o$) of the reinforcement members.

The increased apparent cohesion and the construction spacing between the reinforcement members, therefore, have he following relation:

$$C' = \frac{T_s}{\Delta H} \cdot \frac{\sqrt{K_p}}{2} = \frac{p_u}{\gamma} \cdot \frac{\sqrt{K_p}}{2} \cdot \frac{1}{F_s} \quad \text{[Eq. 22]}$$

$$C' = \frac{\Sigma V_o}{L_o} = \frac{nV_o}{L_0} = \frac{nV_o}{n\bar{\gamma}} = \frac{V_o}{\bar{\gamma}} \quad \text{[Eq. 23]}$$

When the reinforcing steel bar is used as a nail bar, the apparent cohesion to be increased in consideration of corrosion margin of about 3 to 5 mm is as follows:

$$C' \approx \frac{3.9}{\bar{\gamma}} \text{ (t/m}^2\text{)} \left(C' = \frac{3.6}{\bar{\gamma}} \sim \frac{4.2}{\bar{\gamma}}\right)$$

in the case of using a SD40:ϕ25M/M reinforcing steel bar, $$C' \approx \frac{5.2}{\bar{\gamma}} \text{ (t/m}^2\text{)} \left(C' = \frac{4.9}{\bar{\gamma}} \sim \frac{5.6}{\bar{\gamma}}\right)$$

in the case of using a SD40:ϕ29M/M reinforcing steel bar, $$C' \approx \frac{6.4}{\bar{\gamma}} \text{ (t/m}^2\text{)} \left(C' = \frac{5.9}{\bar{\gamma}} \sim \frac{7.5}{\bar{\gamma}}\right)$$

in the case of using a SD40:ϕ32M/M reinforcing steel bar.

The construction density ($\bar{\gamma}$) is 1 piece per 0.64 m$^2$ to 1 piece per 3.0 m$^2$.

Of Eqs. 22 and 23, the one with the smallest value is used for analyzing increase of the apparent cohesion in accordance with the construction density ($\bar{\gamma}$) of the reinforcement members.

The passive side nails cause a shear force and a bending moment on both sides of the potential failure plane within the reinforcement members, but ground displacement in a direction in which the nails and the failure plane form a right angle, that is, displacement necessary for forming the shear resistance and the bending resistance by the nails is larger than that necessary for causing the tensile force within the reinforcement members. In other words, bending stiffness of the reinforcement members substantially has no effect on structure behaviors in a state that the ground displacement is slight. Thus, this means that the shear force built up in the reinforcement members is far smaller than the maximum tensile force, and the bending stiffness substantially has no effect on either the displacement of the failure plane body or the tensile force of the reinforcement members. Because of the balanced distribution of passive earth pressure, the bending moment to the potential failure plane is 0 at a site where the maximum tensile force and the shear force are produced and thus the failure plane within the reinforcement members is displaced in a position behind the reinforcement members by the restraint effect of the ambient friction force.

Reverse analysis is a term used in the present invention, and is defined as a method of designing the construction section by examining deformation of the field ground and studying the external stability condition, followed by studying the internal stability condition; in contrast with the conventional method of designing the construction section by studying the internal stability condition, followed by studying the external stability condition and calculating the stability.

The reason why the reverse analysis technique is used for determining the soil parameters is that clay within the deformed discontinuity or slip plane is difficult to sample, there are many problems caused by using results from soil test of the representative specimen as the representative values for the whole slope, and it is impossible to catch a deformed portion in advance because geological structural characteristics in a highly-weathered slope are not uniform and deformation occurs in a weak portion of the discontinuity. Since the slope has a disadvantageous property that it suffers significant deterioration of strength characteristics together with acceleration of slackness with the passage of time due to relaxation and looseness of all kinds of joints and discontinuities and expansion of viscous earth material filled inside of the slope under the influence of water, it is also impossible to discover this deterioration of the strength characteristics by means of a field survey, a laboratory test and a field in situ test. Besides, as for strength characteristics of a rock, it is unreasonable to regard the results of the laboratory test as the field strength characteristics because of the influence of anisotropy in accordance with a joint property, and the analysis based on the various field in situ tests in a place where deformation in accordance with the anisotropy property occurs and the dynamic laboratory test via sampling does not correspond well with field deformation and degradation behaviors.

That is, a cut slope is a discontinuous body exhibiting complex geological structural characteristics due to having being subjected to a variety of external forces for a long time, and thus the conventional slope reinforcing method by the soil nailing method has a problem in that the assumed conditions do not correspond with reality, because of the phenomena of slackness of the slope and deterioration of joint strength characteristics in accordance with the progress of weathering as time goes by.

The determination of the soil parameters by means of the reverse analysis technique is conducted by use of the Janbu method according to the ground characteristics as follows:

EXAMPLE 1

Reverse Analysis Technique for Strength Characteristics of Weathered Residual Soil Layer Slope or Rock Mass Slope having Remarkable Joint Orientation (Discontinuity)

Figure 7:
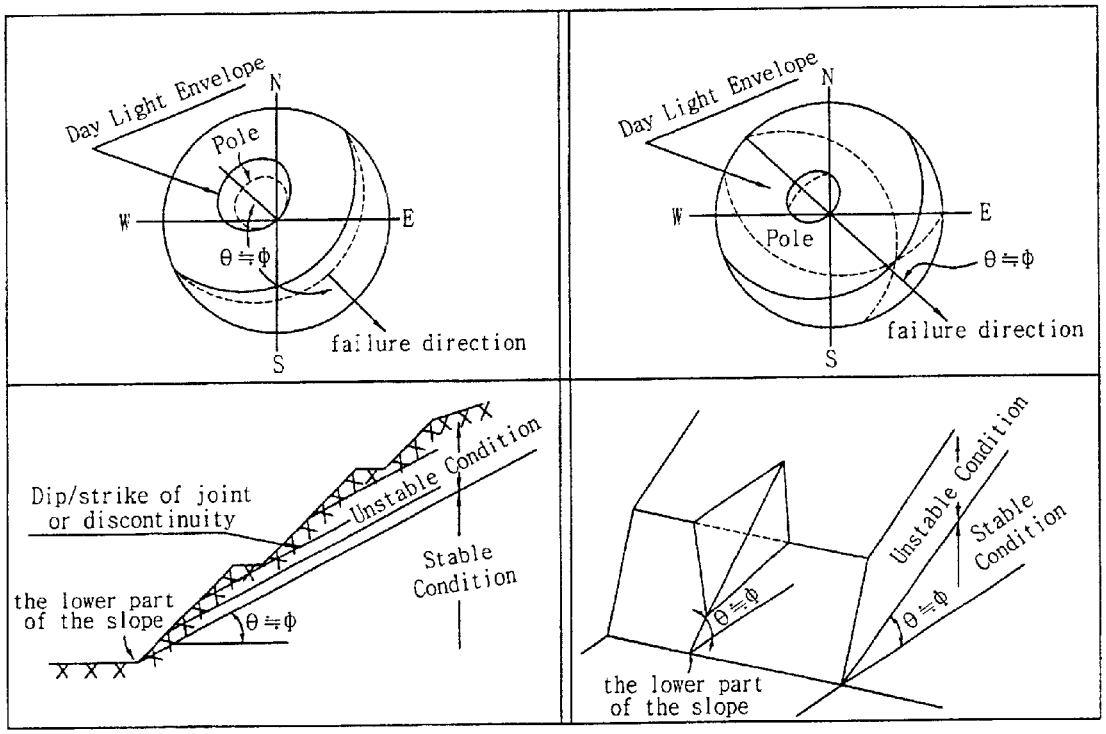
FIG. 7 is a view showing sectional conditions from which strength characteristics of a weathered residual soil layer slope or a rock mass slope having a discontinuity can be analyzed by a reverse analysis technique.

FIG. 7 is a view showing sectional conditions from which strength characteristics of a weathered residual soil layer slope or a rock mass slope having a discontinuity can be analyzed by the reverse analysis technique.

This method is a method considering a dip angle (a bedding plane angle or a plunge angle) capable of causing a slip obtained from result of a stereo net projection for searching orientation of the discontinuity and the joint.

A condition for limit equilibrium state of the slope is $F_s \leqq 1.0$, that is, a condition that the unstable slope (overburden) above the slope dip angle ($\theta$) (in a stable condition) is finally deformed or degraded with the passage of time is $\theta \approx \phi$, and the value of apparent cohesion (C) is determined by inverse calculation thereof under the condition of $F_s \leqq 1.0$.

Although a residual strength ($\phi_r$) is generally smaller than $\phi$ by 5 to 10° When the slope in which the failure actually has occurred is reversely analyzed, it is ignored because it was analyzed as very stable in consideration of the cohesion, and only $\phi$ is considered, or a median value between $\phi$ and $\phi_r$ is used to inversely calculate the value of cohesion and to apply a failure model corresponding to the field conditions through feedbacks of the calculated values of cohesion.

EXAMPLE 2

Figure 8A:
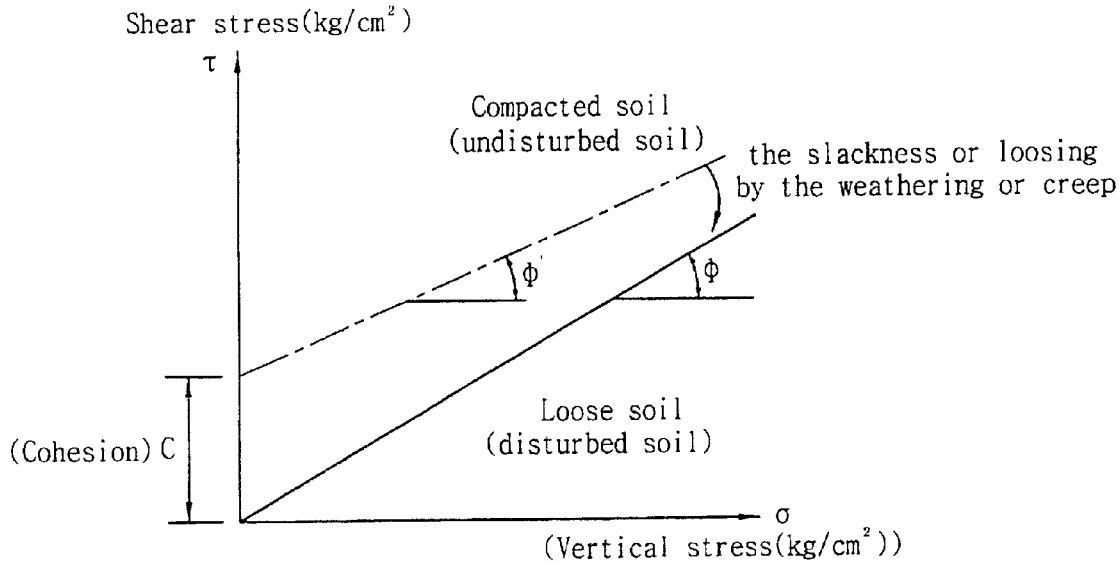
FIGS. 8*a* and 8*b* are views showing sectional conditions from which strength characteristics of an unsaturated earth cut slope ground can be analyzed by the reverse analysis technique.
Figure 8B:
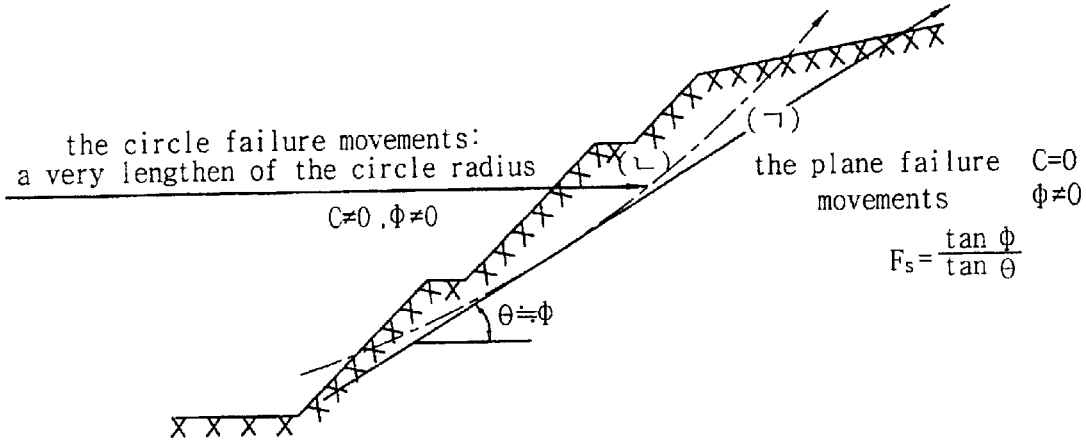

Reverse Analysis Technique for Strength Characteristics of Unsaturated Earth Cut Slope Ground In FIGS. 8*a* and 8*b* are views showing sectional conditions from which strength characteristics of an unsaturated earth cut slope ground can be analyzed by the reverse analysis technique.

In general, sand has a shear strength characteristic that the strength is increased by a cohesion enhancement effect due to an apparent cohesion generated in a compacted state, but the apparent cohesion is lost in a disturbed or deranged state and only a friction resistance of ultimate earth, i.e., an internal friction angle exists to change a residual internal friction angle to an angle of repose. Thus, the deformation of earth slope causes a problem of a falling-off in strength in accordance with the loss of cohesion (C), rather than providing an effect of a lowering of internal friction angle ($\phi$). A basic concept of this example is as follows:

A value of $\phi$ (a peak strength or an average value of the peak strength and a residual strength) is determined by a direct shear test or a ring direct shear test for a ring sampling specimen, the so determined value is taken as $\phi$=const. under a condition for limit equilibrium state $F_s \approx 1.0$, and C is inversely calculated at the constant $\phi$. That is, the value of cohesion is inversely calculated by the Janbu method under the conditions of $\phi$=const. and $F_s \approx 1.0$.

According to a shear strength characteristic based on the present experiential theory, Terzaghi proposed that ultimate strength parameters C' and $\phi'$ in the case of partial shear is applied while being reduced in comparison with those ($C_o$ and $\phi_o$) in the case of normal shear, that is, $$C' = \frac{2}{3}C_o \quad \text{and} \quad \phi' = \tan^{-1}\left(\frac{2}{3}\tan\phi_o\right),$$

but this is only a condition when a horizontal stress is in a restrained state by a vertical stress acting under the ground. The slope cannot secure this restrained state of the horizontal stress. That is, the internal friction angle, one of fundamental properties of earth, changes slightly with the change in acting stress, but the cohesion, another fundamental property of earth, changes very significantly according to the change in conditions such as the compacted state, the slackness with the passage of weathering, etc. Consequently, the cohesion in the final stage is inversely calculated by the Janbu method on the assumption that the angle of repose and the internal friction angle of earth are in equilibrium to each other and in accordance with the field conditions of the slope (considering whether the slope is in a fixedly changed state, a quasi-fixedly changed state or a potentially changed state) while the value of $\phi$ being maintained within a range of residual strength from the peak strength and determined through feedbacks of the calculated valve.

EXAMPLE 3

Figure 9A:
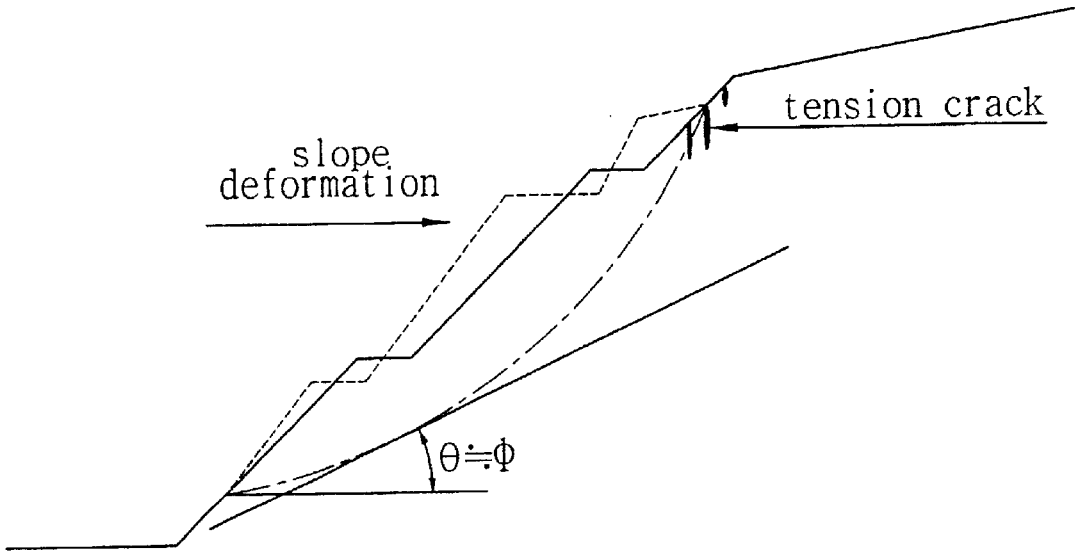
FIGS. 9*a* to 9*c* are views showing sectional conditions from which strength characteristics in accordance with occurrence of degradation or deformation of the slope can be analyzed by the reverse analysis technique.
Figure 9B:
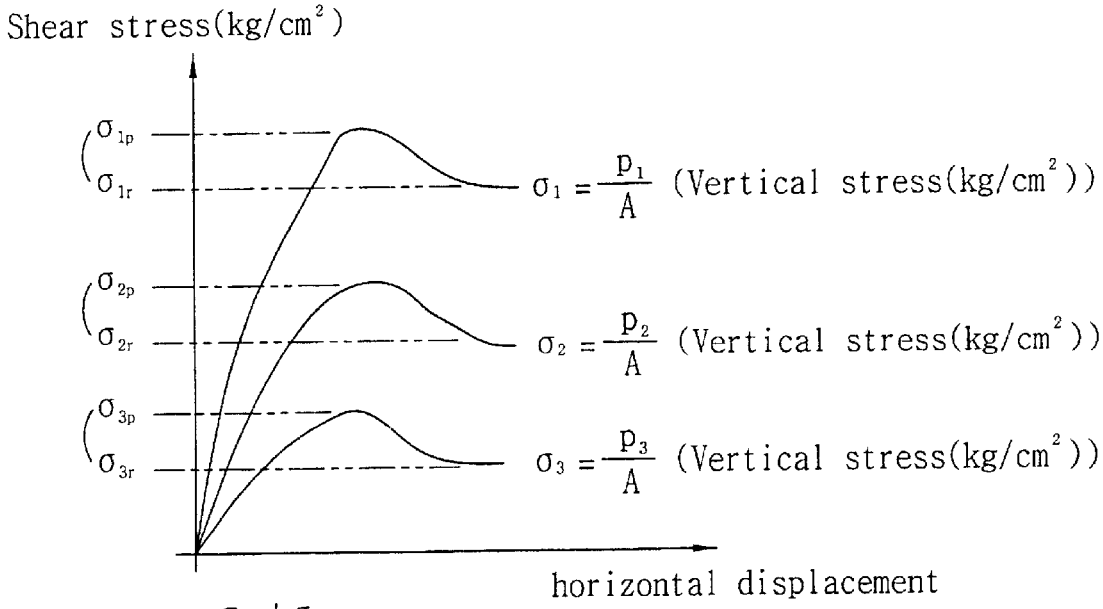
Figure 9C:
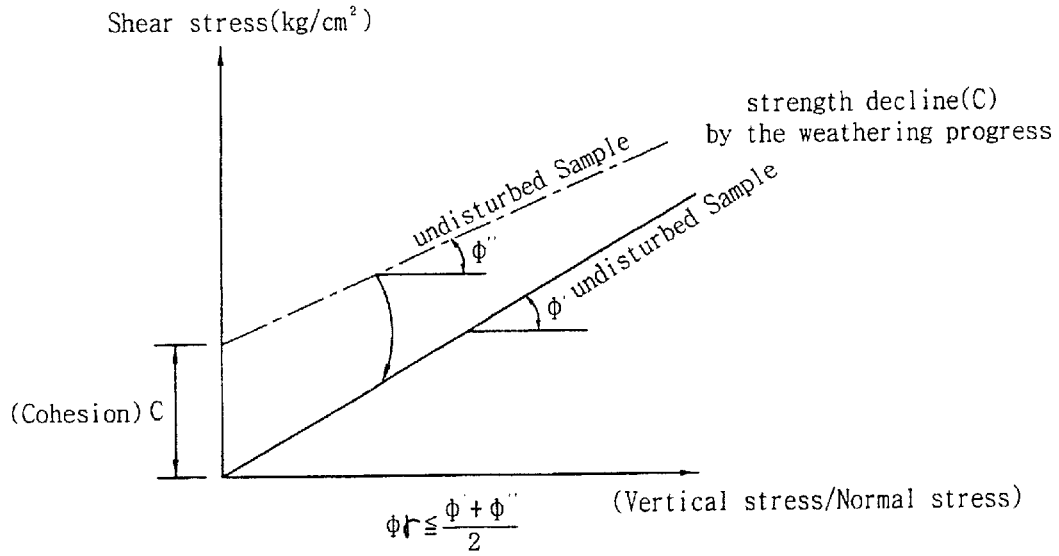

Reverse Analysis Technique for Strength Characteristics in Accordance with Degradation or Deformation of Slope FIGS. 9*a* to 9*c* are views showing sectional conditions from which strength characteristics in accordance with occurrence of degradation or deformation of a slope can be analyzed by the reverse analysis technique.

Taking into account an estimated failure line connecting an upper deformed point with a lower deformed point on the basis of the field deformation model, as shown in FIG. 9*c*, the value of cohesion inversely calculated and determined from $\phi$, by the Janbu method by considering a standard safety factor of $F_s$=0.85~0.9 is used in the case of the fixedly changed state in which slip activity is still going on, a standard safety factor of $F_s$=0.9~0.95 is used in the case of the quasi-fixedly changed state in which the slope was deformed by the slip activity, but the slip activity has stopped (provided that additional deformation may occur by an additional external force and a rainfall), and a standard safety factor of $F_s$=1.0~1.05 is used in the case of the potentially changed state in which only initial deformation occur.

Such a safety factor according to a kind of slope is listed in Table 1 (Experiential theory).

In the case of the rock mass slope, its strength is deteriorated mainly by a decrease of cohesion due to the slackness phenomenon in accordance with infiltration water pressure, progression of weathering and stress release rather than by a lowering of internal friction angle when directions of joint and discontinuity is similar to that of slope, which is the cause of degradation or deformation of the slope.

TABLE 1

| | $F_N$ in slip activity-stopped state | $F_S$ in slip activity-progressing state |
|---|---|---|
| rock mass slope | 1.1 | 0.99 |
| weathered rock slope | 1.05~1.1 | 0.95~0.99 |
| colluvial soil slope | 1.03~1.05 | 0.93~0.95 |
| clayish soil slope | 1.0~1.03 | 0.9~0.93 |
| Note | potentially changed $F_N$ | quasi-fixedly changed $F_S$ |

In the case of the earth slope, its strength is also deteriorated mainly by the decrease of cohesion due to the slackness phenomenon in accordance with infiltration water pressure (usually, a frozen damage in the winter season), progression of weathering and stress release rather than by a lowering of internal friction angle.

In the case of the rock mass slope, therefore, the strength characteristic of the estimated failure line connecting the deformed sections is obtained by the reverse analysis technique described in Example 1, and in the case of the earth slope, the strength characteristic, that is, the value of cohesion is inversely calculated and obtained by the reverse analysis of the Janbu method so as to make it possible to correspond with the field deformed section model according to the technique described in Example 2 or the method of test as shown in FIGS. 9*a* and 9*c* if sampling at the deformed sections is possible and in consideration of only the internal friction angle except the cohesion.

EXAMPLE 4

Figure 10:
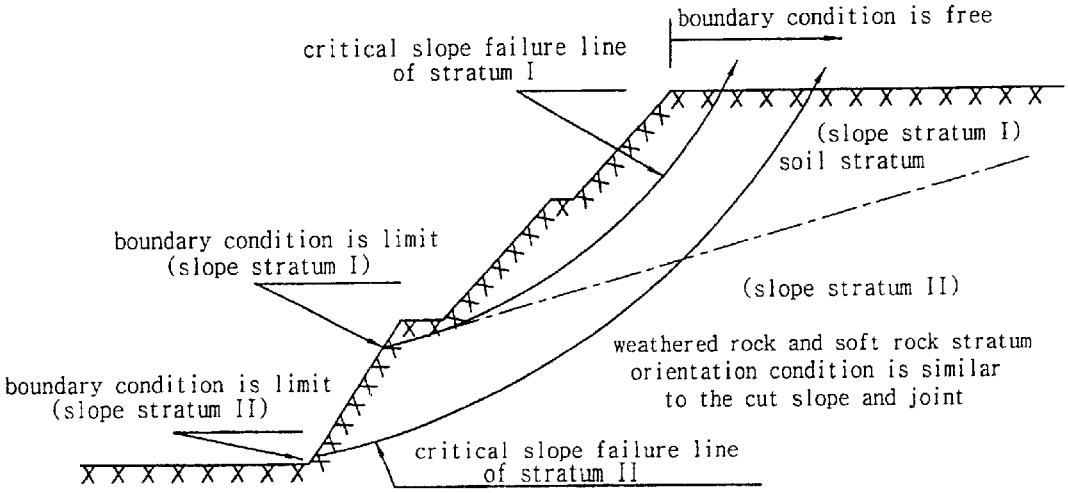
FIG. 10 is a view showing sectional conditions from which strength characteristics can be analyzed by the reverse analysis technique in the case that the slope is unstable and forms an irregular stratified profile.

Reverse Analysis Technique for Strength Characteristics in Case a Slope is Unstable and Forms Irregular Stratified Profile Corresponding to Limit Equilibrium State FIG. 10 is a view showing sectional conditions from which strength characteristics in the case that a slope is unstable and forms an irregular stratified profile can be analyzed by the reverse analysis technique.

(1) Reverse Analysis for Strength Characteristics of Slope Stratum I Assuming that Slope is in Limit Equilibrium State The techniques according to Examples 2 and 3 are used as the reverse analysis techniques for strength characteristics under a condition given as $0.9<F_s<1.05$.

That is, a critical failure line is assumed to pass through the lowest portion of a slope stratum I, and as for an upper portion of the slope stratum I, a value of $\phi$, one of the strength characteristics, is determined and then a value of C, another strength characteristic, is inversely calculated and determined using the techniques according to Examples 2 and 3 by the Janbu method under the condition given as $0.9<F_s<1.05$.

(2) Reverse Analysis for Strength Characteristics of Slope Stratum II Assuming that Slope is in Limit Equilibrium State The strength characteristics are reversely analyzed by the technique according to Example 1 under a condition given as $0.9<F_s<1.05$. Herein, the strength characteristics obtained from the above (1) are used as the strength characteristics to be applied to the slope stratum I.

That is, the critical failure line is assumed to pass through the lowest portion of a slope stratum II, and a value of $\phi$, one of the strength characteristics, is determined and then a value of C, a strength characteristic of the slope stratum II, is inversely calculated and determined using the technique according to Example 1 and the strength characteristics of the slope stratum I obtained from the above (1) by the Janbu method under the condition given as $0.9<F_s<1.05$.

After the soil parameters are determined in such a way, the results of the stability analysis for the slope in the present state are analyzed. The techniques for studying stability of slope can be divided into the Bishop method, the Spencer method and the Janbu method, but the Janbu method is preferred to the others because magnitudes of driving force and resistance force calculated for the same critical slip surface (condition for limit equilibrium state) under the condition of the same safety factor are relatively larger in the Janbu method than in the other methods when a countermeasure is taken to reinforce the cut slope and so the suppression force required for reinforcement is also calculated at a larger value by the Janbu method, the Janbu method analyzes the failure plane assumed considering the ground conditions in place of analyzing a position of a failure source, and the Janbu method capable of being applied to the slope having many rocks solves a problem that a force system acting on a rock is assumed only for unit rock and thus cannot be considered as a force acting between rocks when the analysis is performed in accordance with the experiential relationship or the earth pressure theory. The Janbu method is reasonable in view of securing the slope stability. Thus, the technique for studying the slope stability is conducted using the Janbu method of STABL 5M computer aided analysis programs.

If the soil parameters are determined as a result of the reverse analysis for the field slope conditions, then the external stability of the slope is studied.

Figure 11:
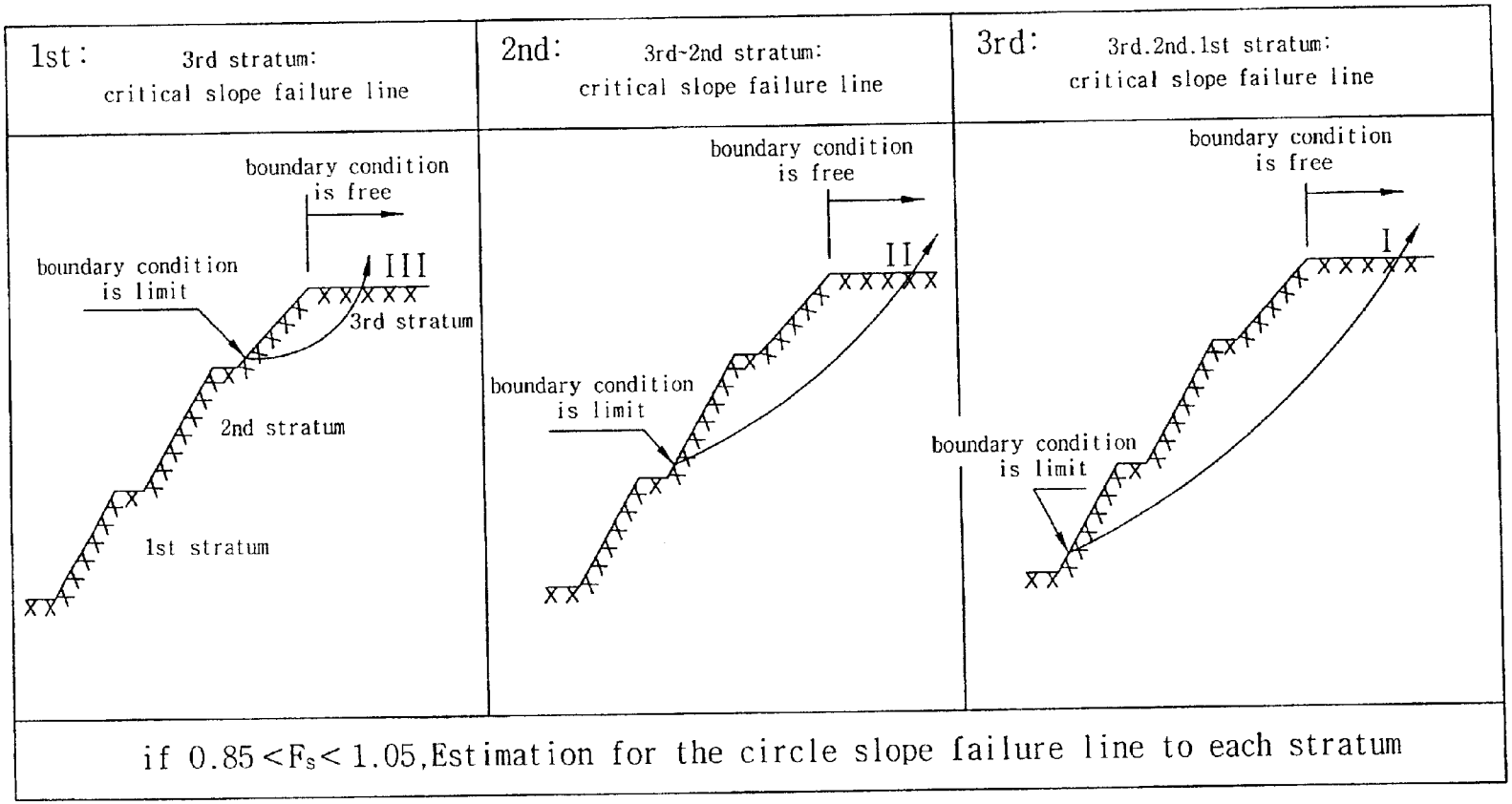
FIG. 11 is a view showing critical failure lines of the respective stratums of the slope.

In order to judge a construction plan of the reinforcement zone for the critical failure line, the slope stability condition is checked prior to initial reinforcement construction. With regard to this, FIG. 11 shows a view which can be used for positional judgment of the critical failure line according to the respective slope stratums.

The reinforcement zone is arbitrarily planned and then a section of the reinforcement zone is planned so as to be adapted to a safety factor condition of $1.4<F_s<1.5$ by use of the trial and error technique.

Figure 12:
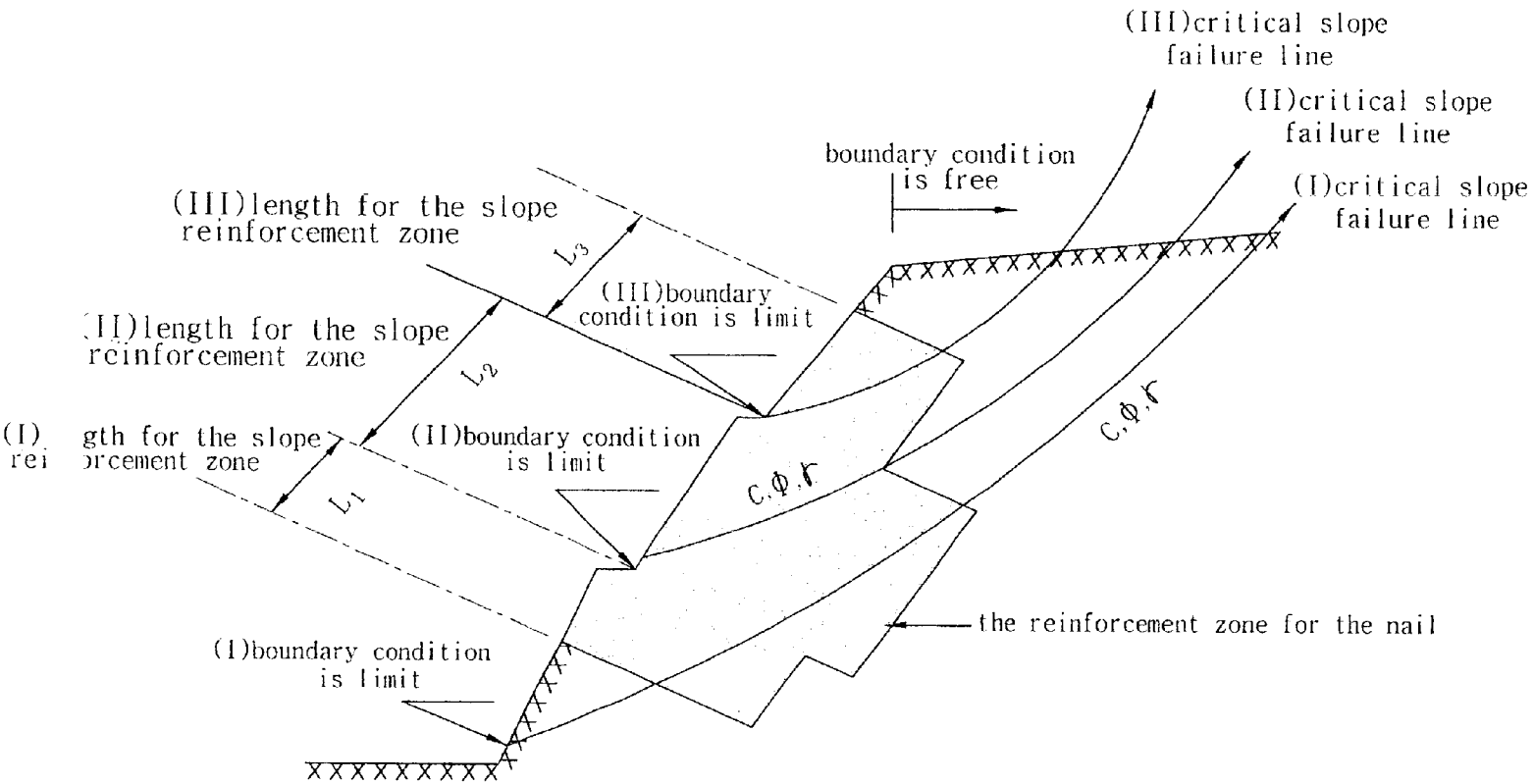
FIG. 12 is a view showing sectional conditions from which positions of the critical failure lines of the respective stratums and strength characteristics can be analyzed by the reverse analysis in the case that the slope is unstable and forms the irregular stratified profile.

FIG. 12 is a view showing sectional conditions from which, in the case that the slope is unstable and forms an irregular stratified profile, positions of the critical failure lines of the respective stratums and the slope stability conditions against the critical failure line can be analyzed by the reverse analysis, and the safety factor condition against the critical failure line is $F_s(III)>1.5$, $F_s(II)>1.4$, $1.4<F_s(I)<1.5$ in FIG. 12.

If the external stability condition for the reinforcement zone is checked, then the internal stability condition is studied.

First, the construction density ($\bar{\gamma}$) is calculated. Since there is a relation of $$\Delta C = \frac{V_o}{\bar{\gamma}} = C' - C,$$

wherein C is the cohesion of the original ground and C' is the increased cohesion of the reinforcement zone, the construction density is expressed as follows:

$$\bar{\gamma} = \frac{V_o}{C' - C} \quad \text{[Exp. 24]}$$

wherein $V_o \approx 3.9$ t in the case of the ϕ25M/M reinforcing steel bar, $V_o \approx 5.2$ t in the case of the ϕ29M/M reinforcing steel bar, and $V_o \approx 6.4$ t in the case of the ϕ32M/M reinforcing steel bar.

Next, the construction spacing between the reinforcement members is calculated.

Since there is a relationship of horizontal spacing ($S_H$) ·vertical spacing($S_V$)=$\bar{\gamma}$, horizontal spacing ($S_H$)=vertical spacing($S_V$)=$\sqrt{\bar{\gamma}}$.

Figure 13:
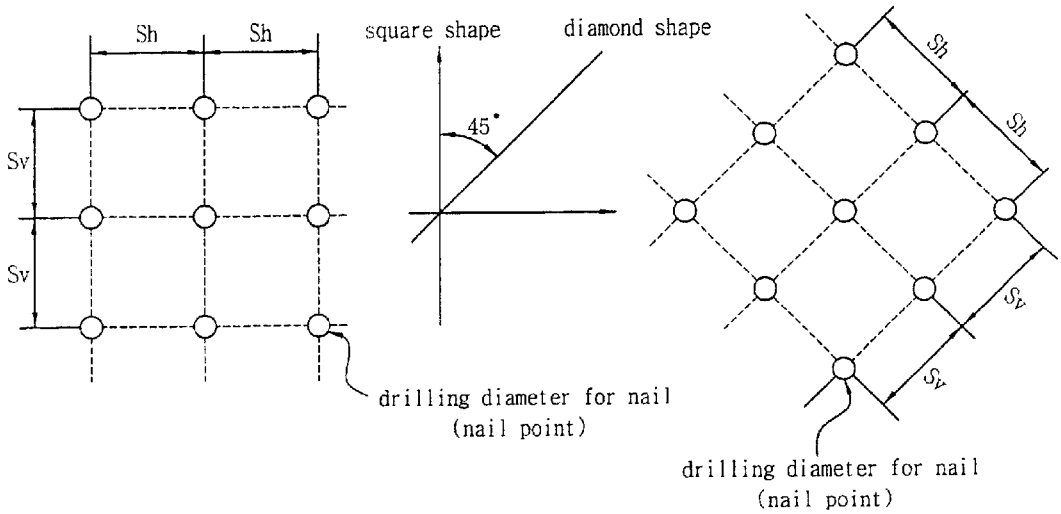
FIG. 13 is a plan layout view in accordance with a rhombus type method of construction in which each construction spacing of a square type method of construction is rotated by 45°.

The construction pattern is planned as a rhombus type construction pattern in which each construction spacing of a square type construction pattern is rotated by 45° as shown in FIG. 13.

After the external stability is studied, a study of the internal stability is performed.

The stability condition against the estimated critical failure line in the respective slope stratums is calculated by the expression of $$F_s = \frac{R_f + P_n}{D_f},$$

the stability condition by the shear force of the nail satisfies $$F_s = \frac{R_f + nV_o}{D_f} > 1.5 \sim 2.0$$

from the relationship that the suppression force required for reinforcement is $P_n = nV_o$, and if the soil is loose (disturbed) soil, the stability based on the skin friction resistance force (tensile force) between a cylindrical body grouted around the nail and the original ground is studied considering the sum total of the skin friction force of a fixation portion with respect to the estimated critical failure line as the suppression force required for reinforcement on the condition of $$F_s = \frac{R_f + nV_o}{D_f} > 1.5 \sim 2.0;$$

suppression force required for reinforcement of subterranean nail $$P_n = n \cdot \pi DL\left(\frac{\tau}{F_s}\right),$$

allowance shear force of a reinforcing steel bar ($V_o$)<skin friction force $$\left(\pi DL\left(\frac{\tau}{F_s}\right)\right),$$

allowance tensile force of a reinforcing steel bar ($T_s$) ≦skin friction force $$\left(\pi DL\left(\frac{\tau}{F_s}\right)\right).$$

Figure 14A:
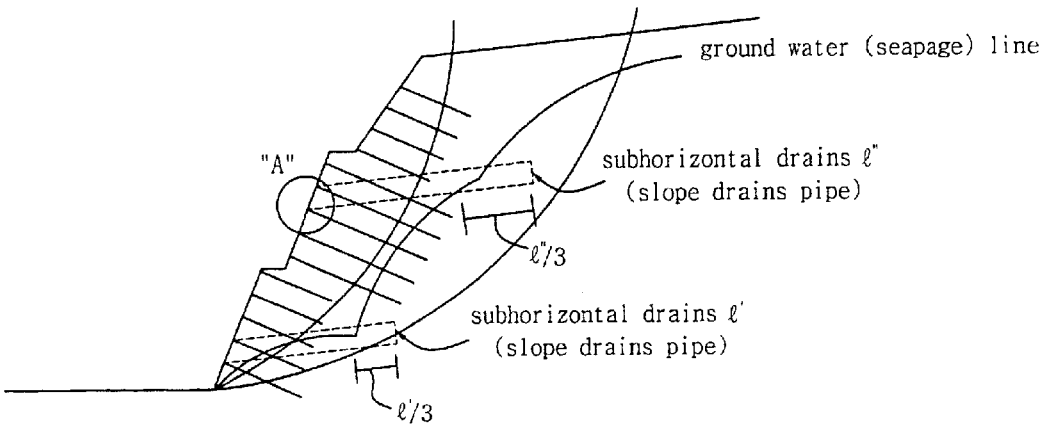
FIGS. 14*a* and 14*b* are a typical sectional layout view of slope drain holes, i.e., subterranean horizontal drain holes in accordance with a position of a underground water level and a plan layout view of the subterranean horizontal drain holes, respectively.
Figure 14B:
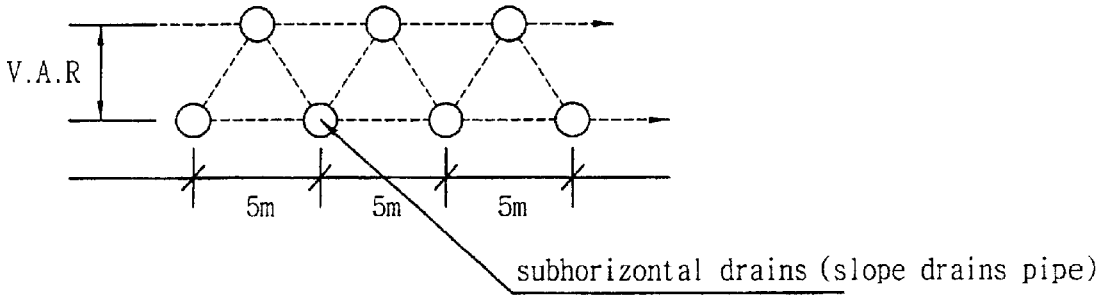

Next, the water level is studied. The condition of fully saturated state of the slope is practically accompanied with many analytical problems because of rainfall, by the reason of which the underground water level line is determined by the slope horizontal drain holes for suppressing rise of the underground water level or lowering the underground water level. The slope horizontal drain holes are provided beyond the reinforcement zone, and the stability analysis of the slope is performed while the seepage line of the underground water level is determined by connecting 2/3 points of the slope horizontal drain holes. At this time, the stability is studied on the condition of $F_s \geqq 1.2$.The subterranean horizontal drain holes, the slope drain holes, are laid in a manner as shown in FIGS. 14*a* and 14*b*.

Figure 15A:
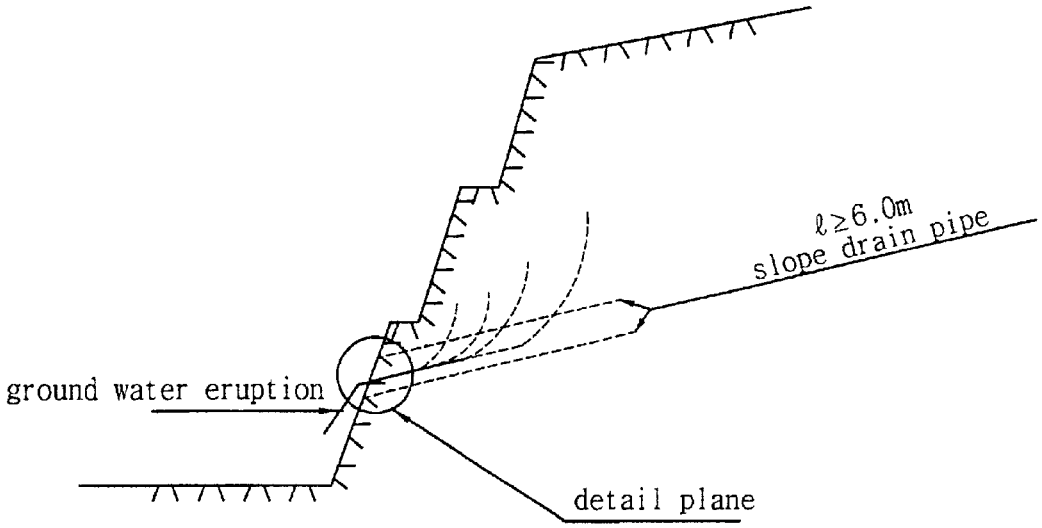
FIGS. 15*a* and 15*b* are a sectional layout view and a plan layout view of the subterranean horizontal drain holes in the case of water eruption.
Figure 15B:
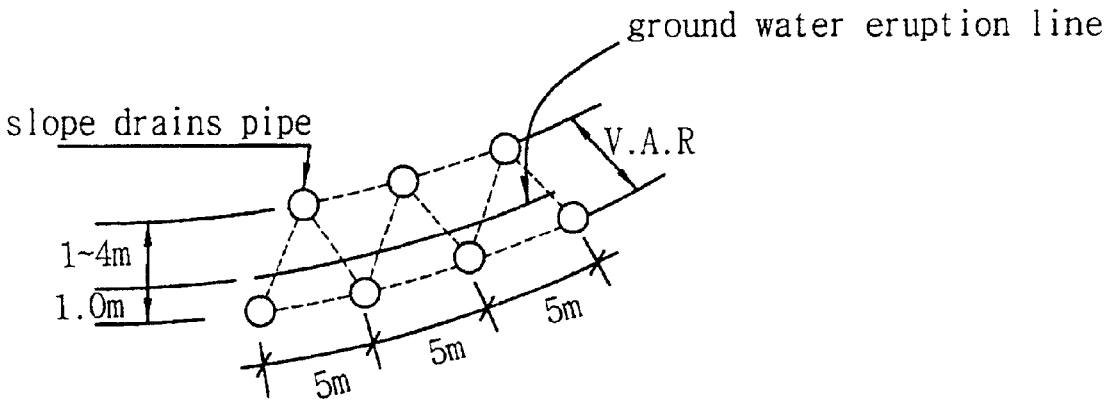

The construction density of the slope horizontal drain holes is determined in a range between a maximum of 1 piece per 30 $m^2$ and a minimum of 1 piece of 10 $m^2$, and the slope horizontal drain holes are arranged in a triangular construction pattern. It is preferred that a borehole drilling diameter is about 3 inches, the drainpipe is a PE or PVC tube of about 2-inch caliber, the drain aperture is formed in a type of strainer, the drainpipe has a circular cross section so as to be cleanable, and the construction direction inclines upwardly to the horizontal plane by about 5 to 10°. In the case of the loose soil layer, the drainpipe is covered with a filter mat. In a section of the slope in which water is erupted by infiltration water, the slope horizontal drain hole is further provided as shown in FIG. 15. When a shallow failure is produced due to minute cavities on the slope surface, the slope surface weathered into a loose state by the lasting rainfall is infiltrated by rainwater so that the slope is maintained in the saturated state from its surface to a certain depth, thereby deteriorating the shear strength characteristic of the earth so considerably as to cause a failure. Accordingly, the analysis for this is carried out as follows:

Primarily considering the lower stratum below the critical failure line as a very stable stratum under the condition of no underground water level and secondarily considering the ground water level to be positioned in a surface portion of the upper stratum above the critical failure line, the stability analysis is performed by use of the reverse analysis technique described in Example 3.The assumed condition of the reverse analysis is that the lower stratum below the critical failure line does not suffer failure. As the reinforcement countermeasure is used the aforementioned methods for enhancing the strength characteristics of earth and excluding the influence of water (increase of pore water pressure due to the ground water level) in which the suppression force required for reinforcement are provided by the apparent cohesion enhancement effect due to the shear strength or the tensile strength (skin friction force) of the reinforcing steel bar, and the ground water level is lowered by the slope horizontal drain holes.

A designed construction section is determined so as to satisfy the above stability conditions. After the construction work in accordance with the designed construction section is done, the surface of the slope is treated by joining earth-pressing steel plates and PVC-coated wire mesh with the reinforcement member and attaching artificial greening soil covering containing natural monofilaments to the surface.

Figure 16:
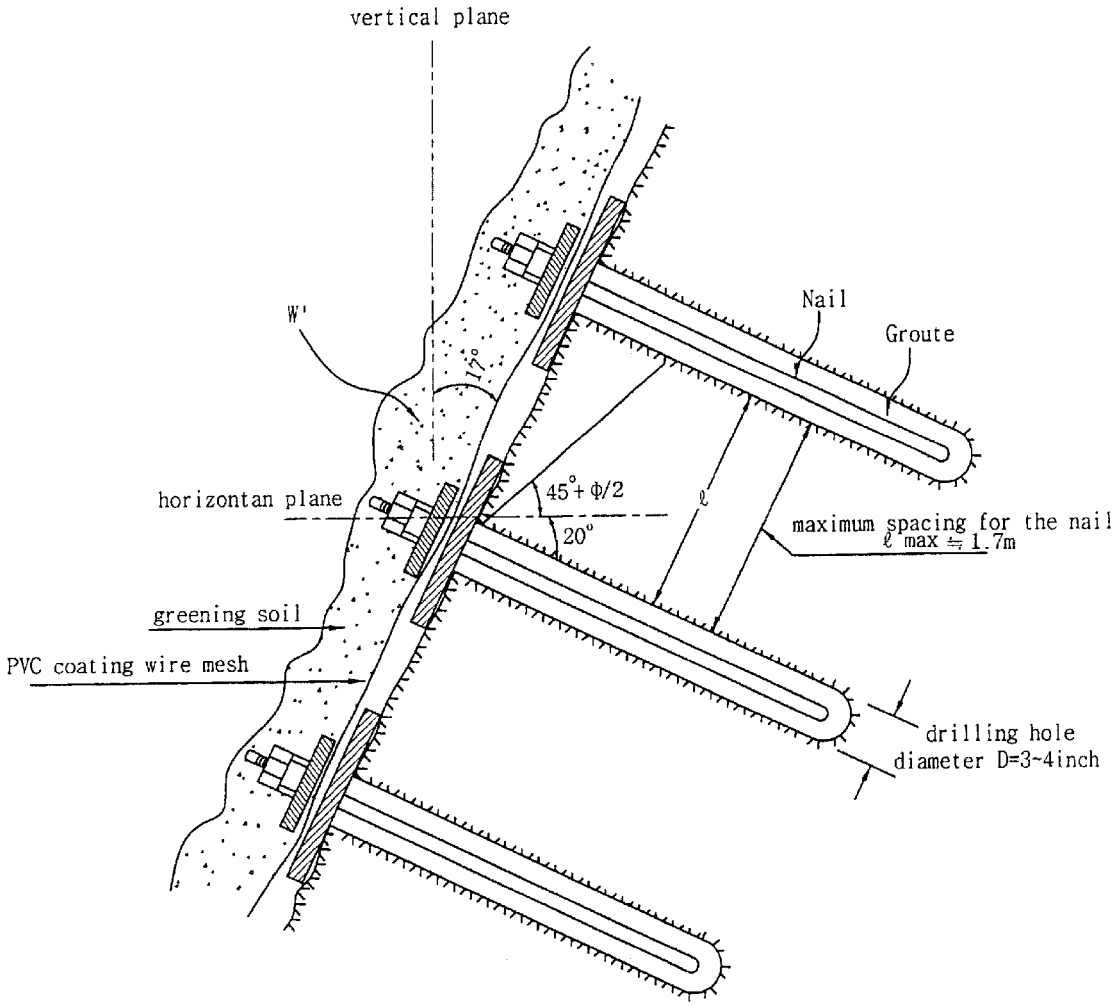
FIG. 16 a view showing boundary conditions for a plastic deformation section of a surface portion of the slope reinforced with reinforcing steel bars.

With regard to this surface treatment, the PVC-coated wire mesh to be used for the surface treatment is provided against the maximal deformation of the surface earth between the nail reinforcement members due to plastic deformation, and the stability condition thereof will be described below with reference to FIG. 16.

A deformed section of the surface per unit linear meter between the nails is expressed by $$A = \frac{l^2 \tan\theta}{2},$$

weight of the deformed section per unit linear meter between the nails is expressed by $$W = r_r A \approx \frac{1.9}{2} l^2 \tan\theta$$

(t/m) (when considering unit weight of the surface of $\gamma_t$=1.9 t/m$^3$), a section of the soil covering per unit linear meter between the nails is expressed by A'=0.1l (when considering a thickness of 10 cm), weight of the soil covering per unit linear meter between the nails is expressed by $W'=r'_l A'=0.16l$ (t/m) (when considering unit weight of the soil covering), an allowance tensile strength of a core wire of the PVC-coated wire mesh per strand is expressed by $P=\sigma_s A_s$, and the allowance tensile strength of the core wire of the PVC-coated wire mesh per unit extension meter is expressed $$P = n\sigma_s A_s \times \frac{1}{\gamma}$$

($\gamma$ is a horizontal construction spacing) when the number of core wire of the PVC-coated wire mesh to be joined with each nail spot is n strands. Thus, the stability condition of the PVC-coated wire mesh is as follows:

Since there is a relationship of $$F_s = \frac{R_f + P}{D_f} > 1.5,$$

cross sectional area of the core wire of -the wire mesh to be used is expressed as below:

$$A_s = (1.5D_f - R_f)\frac{\gamma}{n\sigma_s} \quad \text{[Exp. 25]}$$

wherein A is cross sectional area of the core wire per unit strand, n is the number of strands of the joined core wire, $\sigma_s$ is an allowance tensile strength of the core wire, $\gamma$ is horizontal spacing between the nails, l is vertical spacing between the nails, $R_t$ is a resistance force of the surface deformed section and the artificial soil covering against the slip activity, and $D_t$ is a slip driving force of the surface deformed section and the artificial soil covering, which values are expressed by the following expression $$D_f = W\sin\left(45° + \frac{\phi}{2}\right) + W'\sin\left(45° + \frac{\phi}{2} + \theta\right) \quad \text{[Exp. 26]}$$

$$R_f = \frac{cl}{\cos\left(45° + \frac{\phi}{2}\right)} + W\cos\left(45° + \frac{\phi}{2}\right)\tan\phi + \frac{c'l}{\cos\left(45° + \frac{\phi}{2} + \theta\right)} + W'\cos\left(45° + \frac{\phi}{2} + \theta\right)\tan\phi' \quad \text{[Exp. 27]}$$

c' is the cohesion acting between the soil covering and the surface portion of the slope, and if c'=0, this corresponds to the condition for limit equilibrium state, thus establishing a relational expression of $$\phi' = 45° + \frac{\phi}{2} + \theta.$$

In this case, Exp. 27 is converted to the following expression:

$$R_f = \frac{cl}{\cos\left(45° + \frac{\phi}{2}\right)} + W\cos\left(45° + \frac{\phi}{2}\right)\tan\phi + W'\cos\left(45° + \frac{\phi}{2} + \theta\right)\tan\left(45° + \frac{\phi}{2} + \theta\right) \quad \text{[Exp. 28]}$$

wherein c and $\phi$ are the cohesion and the internal friction angle of earth in the plastic deformation section of the slope surface, and c' and $\phi'$ are the cohesion and the internal friction angle acting on the boundary surface between the soil covering and the slope surface.

If the PVC-coated wire mesh is joined, then the slope surface is treated with general artificial soil covering or artificial soil covering mixed with natural fibers (monofilaments) by a spray attaching vegetation method in order to prevent erosion and outflow of earth in accordance with the plastic deformation of the slope surface and the progression of weathering.

Figure 17:
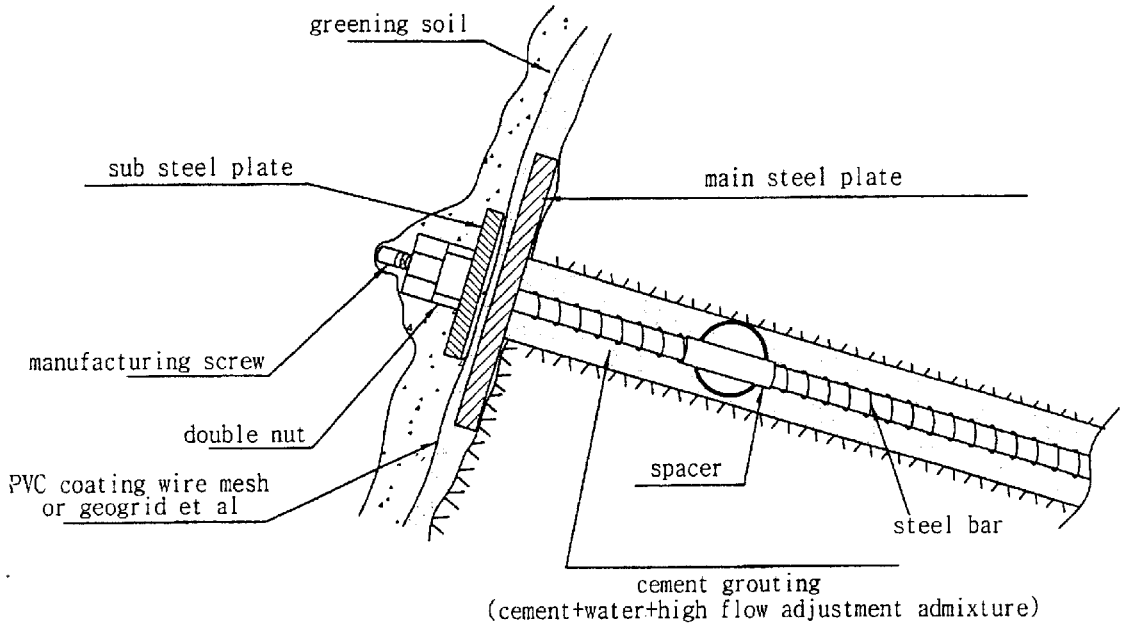
FIG. 17 is a view showing a finished product in a state that nail head portions are joined with a main earth-pressing metal plate, a PVC-coated wire mesh and a sub earth-pressing metal plate by double nuts, and artificial greening soil covering is covered.
Figure 18:
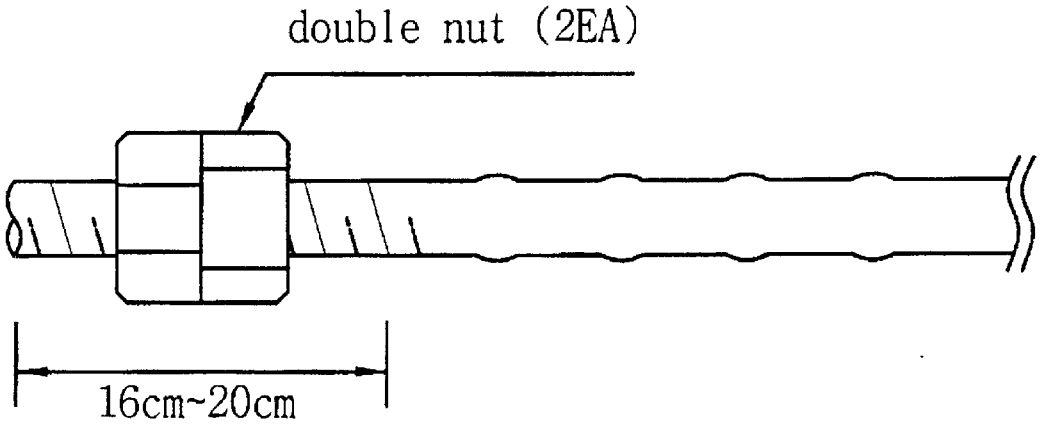
FIG. 18 is a view showing the nail head portions combined with the double nut.

That is, the reinforcement construction work of the slope is carried out in such a manner that a position of drilling point is marked according to the designed construction section as shown in FIG. 17, the marked point is drilled and the reinforcing steel bar is insert-laid in the slope, cement, water and high fluidizing agent are mixed with each other to produce grout and the grout is gravitationally injected around the reinforcing steel bar, the slope drain holes are laid in the slope, metal earth-pressing plates and PVC-coated wire mesh are installed, and the slope surfaces are treated with the general artificial soil covering or the artificial soil covering mixed with natural monofilaments by the spray vegetation attaching method.

As described above, the present invention provides a method for reinforcing a slope, in which an already-constructed slope can reinforced to secure stability and an unstable slope can be restored to its own natural state by means of an environmentally favorable method of construction, strength characteristics are examined by a reverse analysis technique so as to be adapted to given field conditions in accordance with a deformed or degraded state of the ground, and an internal stability condition is studied after an external stability condition is studied using a reinforced theory and then a construction work is carried out, thereby making it possible to rapidly carry out the construction work suitable to the actual field at a low cost.

Although preferred embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. A method for reinforcing a slope using a reverse analysis technique comprising the steps:

a) determining underground water level conditions, slope configuration, soil condition status and rock joint orientation in connection with an applicable limit of the slope;

b) applying the information from step (a) to determine soil parameters including cohesion and an internal friction angle using the Janbu method based on characteristics of the deformed ground;

c) analyzing stability of the slope using the soil parameters determined by the Janbu method to estimate a driving force and a resistance force of the slope;

d) defining a reinforcement zone to be constructed with reinforcement members to increase the resistance force of the slope;

e) determining, the position and number of subterranean horizontal drain holes based on the underground water level conditions to thereby provide external stability;

f) comparing internal stability in the reinforcement zone to a critical failure section based on a pull-out force and shear capacity of the reinforcement member;

g) preparing design drawings that conform to the external and internal stabilities;

h) and carrying out reinforcement construction work, wherein the step of carrying out the reinforcement construction work comprises the steps of:

i) insert-laying the reinforcement members in the slope in accordance with the design drawings;

ii) mixing cement, water and high fluidizing agent to produce grout and gravitationally injecting the grout around the reinforcement members;

iii) laying slope drain holes in the slope in such a manner that they extend beyond the reinforcement zone in accordance with the design drawings;

iv) installing main earth-pressing steel plates, PVC-coated wire mesh and sub-earth pressing steel plates to fix the reinforcement members; and v) applying to surfaces of the slope by a spray vegetation method an artificial soil covering material selected from the group consisting of general artificial soil mixed with natural monofilaments.

2. The method according to claim 1, wherein an apparent cohesion increasing with construction spacing between the reinforcement members is preferably $$C' = \frac{3.6}{\bar{\gamma}} \sim \frac{4.2}{\bar{\gamma}}(t/m^2),$$

where $\bar{\gamma}$ is a construction density of the reinforcement member when a 25 mm diameter reinforcing steel bar is used, $$C' = \frac{4.9}{\bar{\gamma}} \sim \frac{5.6}{\bar{\gamma}}(t/m^2)$$

when a 29 mm diameter reinforcing steel bar is used, $$C' = \frac{5.9}{\bar{\gamma}} \sim \frac{7.5}{\bar{\gamma}}(t/m^2)$$

when a 32 mm diameter reinforcing steel bar is used as a nail bar.

3. The method according to claim 1, wherein a safety factor of the slope is 1.4 or more in the construction section of the reinforcement zone.

4. The method according to claim 1, for use with a weathered residual soil layer slope or a rock mass slope having remarkable joint orientation, which method includes the further steps of determining the soil parameters utilizing a dip angle θ based on a bedding plane angle or a plunge angle θ of the slope joint as the internal friction angle ϕ and inversely calculating cohesion C at the determined internal friction angle under a condition for limit equilibrium state $F_s$, factor of safety, having a value of less than or equal to 1.0.

5. The method according to claim 1, for use with unsaturated earth cut slope ground, wherein the step of determining the soil parameters is performed by determining the internal friction angle ϕ through a direct shear test and inversely calculating the cohesion C at the constant internal friction angle ϕ under a condition for limit equilibrium state where $F_s$, factor of safety, equals 1.0.

6. The method according to claim 1, for use with degradation or deformation of the slope wherein, the step of determining the soil parameters is performed by determining the internal friction angle ϕ by the direct shear test and inversely calculating the cohesion C using an estimated failure line under a condition for limit equilibrium state where the factor of safety $F_s$, has a value from 0.85 to 1.03.

7. The method according to claim 1, for use with a slope that is unstable and forms an irregular stratified profile corresponding to a limit equilibrium state, the step of determining the soil parameters being performed first by assuming that a critical failure line passes through the lowest portion of an upper stratum of the slope, determining the internal friction angle $\phi_r$ through the direct shear test for a portion of the upper stratum of the slope, and inversely calculating the cohesion C under a condition for limit equilibrium state 0.9 where the factor of safety, $F_s$ has a value from 0.9 to 1.05, and further by assuming that the critical failure line passes through the lowest portion of a lower stratum of the slope, determining the internal friction angle $\phi_r'$ through the direct shear test for a portion of the upper stratum of the slope.

* * * * *